US008847181B2

(12) United States Patent
Moriya et al.

(10) Patent No.: US 8,847,181 B2
(45) Date of Patent: Sep. 30, 2014

(54) SYSTEM AND METHOD FOR GENERATING EXTREME ULTRAVIOLET LIGHT

(75) Inventors: Masato Moriya, Oyama (JP); Hideyuki Hayashi, Hiratsuka (JP); Osamu Wakabayashi, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 13/402,277

(22) Filed: Feb. 22, 2012

(65) Prior Publication Data

US 2012/0228525 A1 Sep. 13, 2012

(30) Foreign Application Priority Data

Mar. 10, 2011 (JP) ..... 2011-052917
Dec. 12, 2011 (JP) ..... 2011-271331

(51) Int. Cl.
*H05G 2/00* (2006.01)
*G21K 5/00* (2006.01)

(52) U.S. Cl.
CPC ..... *H05G 2/008* (2013.01); *H05G 2/006* (2013.01); *H05G 2/003* (2013.01)
USPC ..... 250/504 R; 355/67

(58) Field of Classification Search
CPC ..... H05G 2/00; H05G 2/001; H05G 2/003; H05G 2/005; H05G 2/006; H05G 2/008; G03F 7/70008; G03F 7/70016; G03F 7/70025; G03F 7/70033
USPC ..... 250/493.1, 494.1, 503.1, 504 R; 355/67, 355/30
See application file for complete search history.

(56) References Cited

U.S. PATENT DOCUMENTS

| | | | | |
|---|---|---|---|---|
| 2003/0035091 | A1 | 2/2003 | Kohno | |
| 2004/0264512 | A1 * | 12/2004 | Hartlove et al. | 372/5 |
| 2006/0219957 | A1 | 10/2006 | Ershov et al. | |
| 2007/0158579 | A1 | 7/2007 | Moors et al. | |
| 2007/0158597 | A1 * | 7/2007 | Fomenkov et al. | 250/504 R |
| 2008/0116396 | A1 * | 5/2008 | Kondo et al. | 250/492.3 |
| 2008/0197297 | A1 * | 8/2008 | Akins et al. | 250/504 R |
| 2008/0233719 | A1 | 9/2008 | Omata | |
| 2009/0161201 | A1 * | 6/2009 | Ershov et al. | 359/333 |
| 2010/0117009 | A1 * | 5/2010 | Moriya et al. | 250/504 R |
| 2010/0140512 | A1 * | 6/2010 | Suganuma et al. | 250/504 R |
| 2010/0171049 | A1 * | 7/2010 | Moriya et al. | 250/504 R |
| 2010/0176310 | A1 | 7/2010 | Moriya et al. | |
| 2010/0258750 | A1 * | 10/2010 | Partlo et al. | 250/504 R |
| 2010/0327192 | A1 | 12/2010 | Fomenkov et al. | |
| 2011/0220816 | A1 | 9/2011 | Kakizaki et al. | |

FOREIGN PATENT DOCUMENTS

JP 08-213193 8/1996

* cited by examiner

*Primary Examiner* — Nicole Ippolito
*Assistant Examiner* — David E Smith
(74) *Attorney, Agent, or Firm* — McDermott Will & Emery LLP

(57) ABSTRACT

Systems and methods are provided in which an extreme ultraviolet (EUV) light generation apparatus used with a laser apparatus is configured to detect an image of a laser beam by which a target has been irradiated. The EUV light generation apparatus may also be configured to control the position at which a laser beam is to be focused and the position of a target, based on the detection result.

11 Claims, 24 Drawing Sheets

SYSTEM AND METHOD FOR GENERATING EXTREME ULTRAVIOLET LIGHT

CROSS-REFERENCE TO RELATED APPLICATIONS

The present application claims priority from Japanese Patent Application No. 2011-052917 filed Mar. 10, 2011, and Japanese Patent Application No. 2011-271331 filed Dec. 12, 2011.

BACKGROUND

1. Technical Field

This disclosure relates to a system and a method for generating extreme ultraviolet (EUV) light.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes of 60 nm to 45 nm, and microfabrication with feature sizes of 32 nm or less, will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a LPP (Laser Produced Plasma) type system in which plasma is generated by irradiating a target material with a laser beam, a DPP (Discharge Produced Plasma) type system in which plasma is generated by electric discharge, and a SR (Synchrotron Radiation) type system in which orbital radiation is used.

SUMMARY

An extreme ultraviolet light generation system according to one aspect of this disclosure may include: a laser apparatus configured to output a laser beam; a chamber provided with a window, through which the laser beam from the laser apparatus enters the chamber; a target supply unit configured to output a target toward a predetermined position inside the chamber; a laser beam focusing optical system positioned to reflect the laser beam toward a predetermined position inside the chamber; a detector for detecting an image of the laser beam at the predetermined position; a target position adjusting mechanism for adjusting a direction into which the target is to be outputted; a laser beam focus position adjusting mechanism for adjusting a focus position of the laser beam; and a controller for controlling the target position adjusting mechanism and the laser beam focus position adjusting mechanism based on the image detected by the detector.

An extreme ultraviolet light generation system according to another aspect of this disclosure may include: a first laser apparatus configured to output a first laser beam; a second laser apparatus configured to output a second laser beam; a chamber provided with a window, through which the first and second laser beams respectively from the first and second laser apparatuses enter the chamber; a target supply unit for outputting a target toward a predetermined position inside the chamber; a laser beam focusing optical system positioned to reflect the first and second laser beams toward a predetermined position; a detector for detecting an image of the second laser beam at the predetermined position; a target position adjusting mechanism for adjusting a direction into which the target is to be outputted; a laser beam focus position adjusting mechanism for adjusting a focus position of at least one of the first and second laser beams; and a controller for controlling the target position adjusting mechanism and the laser beam focus position adjusting mechanism based on the image detected by the detector.

A method according to yet another aspect of this disclosure for generating extreme ultraviolet light in a system including a laser apparatus, a chamber, a target supply unit, a laser beam focusing optical system, a detector, a target position adjusting mechanism, a laser beam focus position adjusting mechanism, and a controller may include: detecting an image of a laser beam reflected by the laser beam focusing optical system at a predetermined position; and controlling the target position adjusting mechanism and the laser beam focus position adjusting mechanism based on the detected image.

A method according to still another aspect of this disclosure for generating extreme ultraviolet light in a system including first and second laser apparatuses, a chamber, a target supply unit, a laser beam focusing optical system, a detector, a target position adjusting mechanism, a laser beam focus position adjusting mechanism, and a controller may include: outputting first and second laser beams respectively from the first and second laser apparatuses; detecting an image of the second laser beam reflected by the laser beam focusing optical system at a predetermined position; and controlling the target position adjusting mechanism and the laser beam focus position adjusting mechanism based on the detected image.

BRIEF DESCRIPTION OF THE DRAWINGS

Hereinafter, selected embodiments of this disclosure will be described with reference to the accompanying drawings.

DESCRIPTION OF PREFERRED EMBODIMENTS

Figure 1:
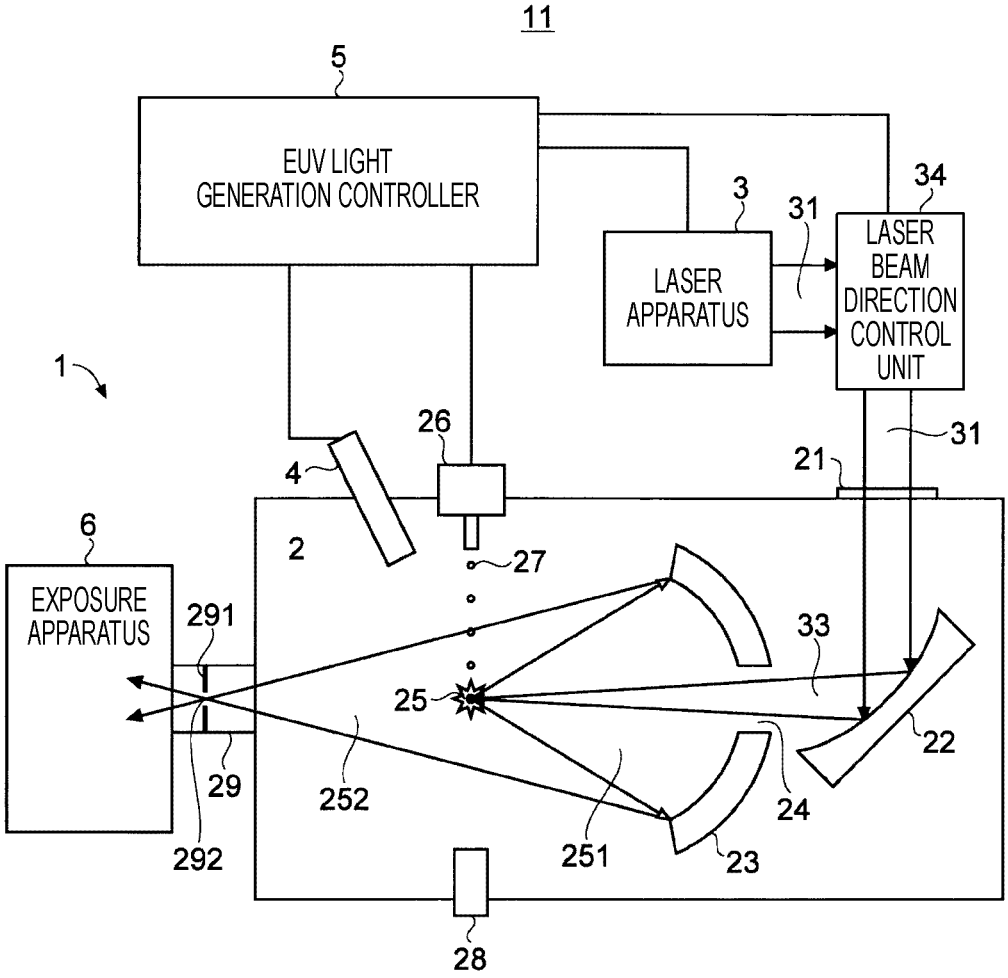
FIG. 1 schematically illustrates the configuration of an exemplary LPP type EUV light generation system.

Hereinafter, selected embodiments of this disclosure will be described in detail with reference to the accompanying drawings. The embodiments to be described below are merely illustrative in nature and do not limit the scope of this disclosure. Further, the configuration(s) and operation(s) described in each embodiment are not all essential in implementing this disclosure. Note that like elements are referenced by like reference numerals and characters, and duplicate descriptions thereof will be omitted herein. This disclosure will be illustrated following the table of contents below.

Contents

1. Summary
2. Terms
3. Overview of EUV Light Generation System
3.1 Configuration
3.2 Operation
4. EUV Light Generation System Including Laser Beam Irradiation Image Detector
4.1 Configuration
4.2 Operation
4.3 Effect
4.4 Image when Target is Irradiated by Laser Beam
4.5 Control Flow
4.5.1 Main Flow
4.5.2 Parameter Initialization Subroutine
4.5.3 EUV Light Generation Position Setting Subroutine
4.5.4 EUV Light Generation Subroutine
4.5.5 Laser Beam Irradiation Image Detection Subroutine
4.5.6 Position Determination Subroutine
4.5.7 Target Position Control Subroutine
4.5.7.1 Modification of Target Position Control Subroutine
4.5.8 Laser Beam Focus Position Control Subroutine
5. EUV Light Generation System Including Image Detector for Detecting Images when Target is Irradiated by Pre-Pulse and Main Pulse Laser Beams
5.1 Configuration
5.2 Operation
5.3 Effect
5.4 Image when Target is Irradiated by Main Pulse Laser Beam
5.5 Control Flow
5.5.1 Parameter Initialization Subroutine
5.5.2 EUV Light Generation Subroutine
6. EUV Light Generation System in which Beam Delivery System Includes Actuator for Adjusting Focus of Laser Beam
6.1 Configuration
6.2 Operation
6.3 Effect
7. Supplementary Descriptions
7.1 Two-Axis Tilt Stage
7.2 Focus Position Adjusting Mechanism
7.3 Modification of Focus Position Adjusting Mechanism
7.4 Top-Hat Mechanism
7.5 First Modification of Top-Hat Mechanism
7.6 Second Modification of Top-Hat Mechanism 1. Summary An overview of the embodiments is as follows. In the selected embodiments to be described below, an EUV light generation apparatus used with a laser apparatus may be configured to detect an image of a laser beam by which a target has been irradiated. The EUV light generation apparatus may also be configured to control the position at which a laser beam is to be focused and the position of a target, based on the aforementioned detection result.

2. Terms

Terms used in this application may be interpreted as follows. The term "droplet" may refer to one or more liquid droplet(s) of a molten target material. Accordingly, the shape of a droplet may be substantially spherical due to its surface tension. The term "plasma generation region" may refer to a three-dimensional space in which plasma is to be generated. In a beam path of a laser beam, a direction or side closer to the laser apparatus is referred to as "upstream," and a direction or side closer to the plasma generation region is referred to as "downstream." The "predetermined repetition rate" does not have to be a constant repetition rate but may, in some examples, be a substantially constant repetition rate. The term "diffused target" refers to a target material in a state where at least one of pre-plasma and fragments of the target material is included. The term "pre-plasma" refers to a target material in a plasma state or in a state where plasma is mixed with its atoms or molecules. The term "fragments" may include fine particles such as clusters and microdroplets transformed from a target material as the target material is irradiated by the laser beam, or a mixture of such fine particles. The term "obscuration region" refers to a three-dimensional space defined by the specifications of an external apparatus, such as the exposure apparatus. Typically, the EUV light that passes through the obscuration region is not used for exposure in the exposure apparatus.

3. Overview of EUV Light Generation System 3.1 Configuration

FIG. 1 schematically illustrates the configuration of an exemplary LPP type EUV light generation system. An EUV light generation apparatus 1 may be used with at least one laser apparatus 3. In this application, a system including the EUV light generation apparatus 1 and the laser apparatus 3 may be referred to as an EUV light generation system 11. As illustrated in FIG. 1 and described in detail below, the EUV light generation apparatus 1 may include a chamber 2, a target supply unit (droplet generator 26, for example), and so forth. The chamber 2 may be airtightly sealed. The target supply unit may be mounted to the chamber 2 so as to penetrate the wall of the chamber 2, for example. A target material to be supplied by the target supply unit may include, but is not limited to, tin, terbium, gadolinium, lithium, xenon, or any combination, alloy, or mixture thereof.

The chamber 2 may have at least one through-hole formed in the wall thereof. The through-hole may be covered with a window 21, and a pulsed laser beam 31 may travel through the window 21 into the chamber 2. An EUV collector mirror 23 having a spheroidal surface may be disposed inside the chamber 2, for example. The EUV collector mirror 23 may have a multi-layered reflective film formed on the spheroidal surface, and the reflective film may include molybdenum and silicon that are laminated in alternate layers, for example. The EUV collector mirror 23 may have first and second foci. The EUV collector mirror 23 may preferably be disposed such that the first focus thereof lies in a plasma generation region 25 and the second focus thereof lies in an intermediate focus (IF) region 292 defined by the specification of an exposure apparatus 6. The EUV collector mirror 23 may have a through-hole 24 formed at the center thereof, and a pulsed laser beam 33 may travel through the through-hole 24.

Referring again to FIG. 1, the EUV light generation system 11 may include an EUV light generation controller 5. Further, the EUV light generation apparatus 1 may include a target sensor 4. The target sensor 4 may be equipped with an imaging function and may detect at least one of the presence, trajectory, and position of a target.

Further, the EUV light generation apparatus 1 may include a connection part 29 for allowing the interior of the chamber 2 and the interior of the exposure apparatus 6 to be in communication with each other. A wall 291 having an aperture may be disposed inside the connection part 29. The wall 291 may be disposed such that the second focus of the EUV collector mirror 23 lies in the aperture formed in the wall 291.

Further, the EUV light generation system 1 may include a laser beam direction control unit 34, a laser beam focusing mirror 22, and a target collection unit 28 for collecting a target 27. The laser beam direction control unit 34 may include an optical element for defining the direction in which the laser beam travels and an actuator for adjusting the position and the orientation (or posture) of the optical element.

3.2 Operation

With reference to FIG. 1, the pulsed laser beam 31 outputted from the laser apparatus 3 may pass through the laser beam direction control unit 34, and may be outputted from the laser beam direction control unit 34 after having its direction optionally adjusted. The pulsed laser beam 31 may travel through the window 21 and enter the chamber 2. The pulsed laser beam 31 may travel inside the chamber 2 along at least one beam path from the laser apparatus 3, be reflected by the laser beam focusing mirror 22, and strike at least one target 27, as the pulsed laser beam 33.

The droplet generator 26 may output the targets 27 toward the plasma generation region 25 inside the chamber 2. The target 27 may be irradiated by at least one pulse of the pulsed laser beam 33. The target 27, which has been irradiated by the pulsed laser beam 33, may be turned into plasma, and rays of light, including EUV light 251, may be emitted from the plasma. The EUV light 251 may be reflected selectively by the EUV collector mirror 23. EUV light 252 reflected by the EUV collector mirror 23 may travel through the intermediate focus region 292 and be outputted to the exposure apparatus 6. The target 27 may be irradiated by multiple pulses included in the pulsed laser beam 33.

The EUV light generation controller 5 may integrally control the EUV light generation system 11. The EUV light generation controller 5 may process image data of the droplet 27 captured by the target sensor 4. Further, the EUV light generation controller 5 may control at least one of the timing at which the target 27 is outputted and the direction into which the target 27 is outputted (e.g., the timing with which and/or direction in which the target is outputted from the droplet generator 26), for example. Furthermore, the EUV light generation controller 5 may control at least one of the timing with which the laser apparatus 3 oscillates (e.g., by controlling laser apparatus 3), the direction in which the pulsed laser beam 31 travels (e.g., by controlling laser beam direction control unit 34), and the position at which the pulsed laser beam 33 is focused (e.g., by controlling laser apparatus 3, laser beam direction control unit 34, or the like), for example. The various controls mentioned above are merely examples, and other controls may be added as necessary.

4. EUV Light Generation System Including Laser Beam Irradiation Image Detector

Figure 2:
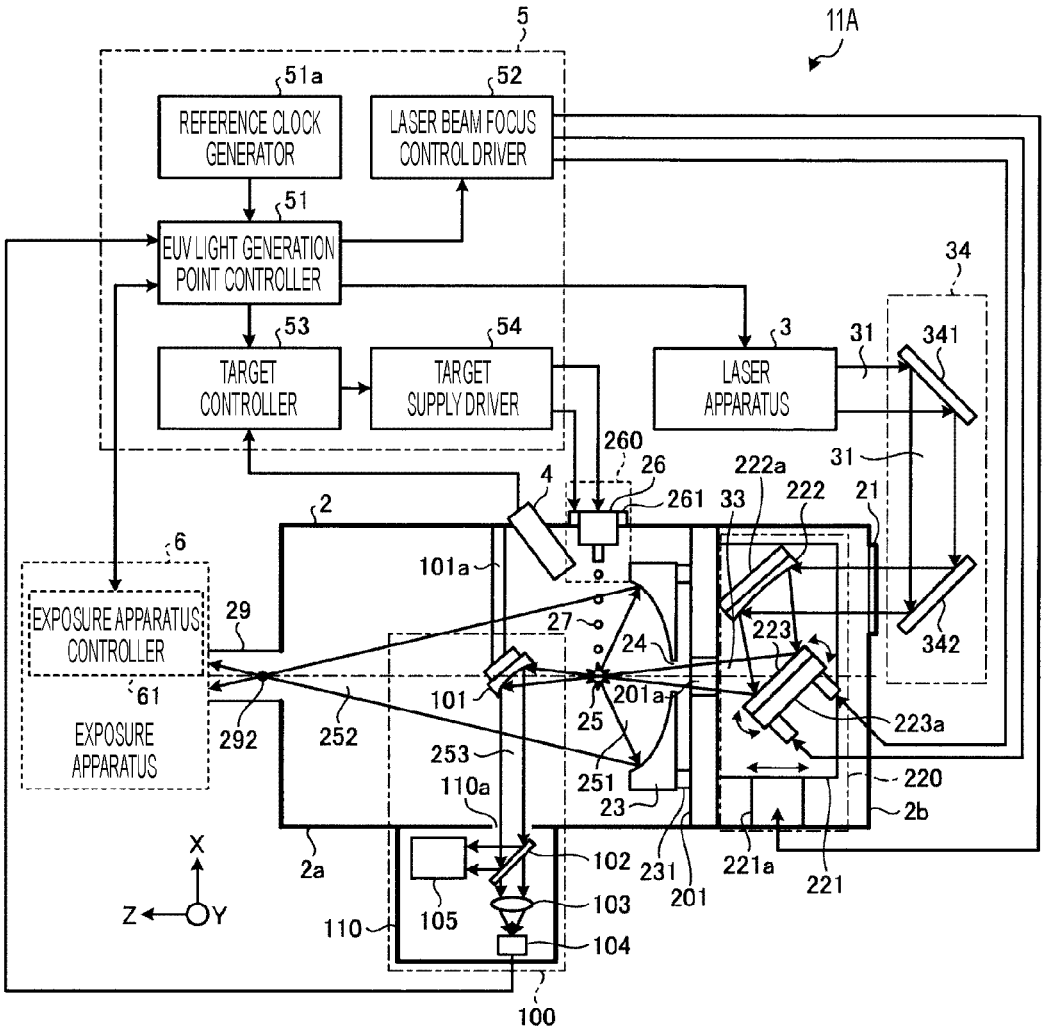
FIG. 2 schematically illustrates the configuration of an EUV light generation system including a laser beam irradiation image detector according to one embodiment of this disclosure.

Subsequently, an EUV light generation apparatus including a laser beam irradiation image detector for detecting an image of the laser beam passing around the target will be described with reference to the drawings. FIG. 2 schematically illustrates the configuration of an EUV light generation system 11A including a laser beam irradiation image detector 100.

4.1 Configuration

As illustrated in FIG. 2, the EUV light generation system 11A may include the EUV light generation controller 5, the laser apparatus 3, the laser beam direction control unit (hereinafter, also referred to as a beam delivery unit) 34, and the chamber 2.

The chamber 2 may include a main chamber 2*a*, into which the targets 27 are to be supplied, and a sub-chamber 2*b*, in which a laser beam focusing optical system 220 is disposed. The main chamber 2*a* and the sub-chamber 2*b* may be divided by a partition plate 201 having a through-hole formed at the center thereof, through which the pulsed laser beam 33 may pass. Alternatively, the main chamber 2*a* and the sub-chamber 2*b* may be separate chambers which may be integrated. However, this embodiment is not limited thereto, and the main chamber 2*a* and the sub-chamber 2*b* may be formed by dividing a single chamber into two with the partition plate 201.

The laser beam focusing optical system 220 disposed inside the sub-chamber 2*b* may include an off-axis paraboloidal concave mirror 222 and a high-reflection mirror 223, for example. The off-axis paraboloidal concave mirror 222 may be attached to a base plate 221 through a mirror holder 222*a*, for example. The high-reflection mirror 223 may be attached to the base plate 221 through a two-axis tilt stage 223*a* (this may correspond to a laser beam focus position adjusting mechanism), for example. The base plate 221 may be movable in the Z-direction through a single-axis stage 221*a* (this may correspond to a laser beam focus position adjusting mechanism), for example. The high-reflection mirror 223 may have its tilt angles θx and θy adjusted through the two-axis tilt stage 223*a*. Here, the tilt angle θx may be a pitch angle and the tile angle θy may be a yaw angle with respect to an angle formed by a normal line at the center of the reflective surface of the high-reflection mirror 223 and the installation surface of the two-axis tilt stage 223*a* on the base plate 221.

The pulsed laser beam 31 may be reflected by high-reflection mirrors 341 and 342 of the beam delivery unit 34 and may enter the sub-chamber 2*b* via the window 21. The pulsed laser beam 31 that has entered the sub-chamber 2*b* may be reflected by the off-axis paraboloidal concave mirror 222. With this, the pulsed laser beam 31 may be transformed into a converging pulsed laser beam 33. Thereafter, the pulsed laser beam 33 may be reflected by the high-reflection mirror 223, and may enter the main chamber 2*a* via a through-hole 201*a*.

The main chamber 2*a* may include the EUV collector mirror 23, a target supply unit 260, the target sensor 4, and a laser beam irradiation image detector 100. The EUV collector mirror 23 may be attached to the partition plate 201 through an EUV collector mirror holder 231, for example. The through-hole 24 in the EUV collector mirror 23 and the through-hole 201*a* in the partition plate 201 may each be sized not to block the pulsed laser beam 33 when the pulsed laser beam 33 passes through the respective through-holes. The target supply unit 260 may include the droplet generator 26 and a two-axis stage 261 (this may correspond to a target position adjusting mechanism). The droplet generator 26 may be attached to the main chamber 2*a* through the two-axis stage 261. The two-axis stage 261 may be configured to move the droplet generator 26 in the Y-direction and the Z-direction, whereby the position at which the target 27 passes through the plasma generation region 25 may be adjusted.

The laser beam irradiation image detector 100 may include an off-axis paraboloidal mirror 101, a beam splitter 102, an imaging lens 103, an image sensor 104, and a beam dump 105. The off-axis paraboloidal mirror 101 may be attached to the inner wall of the main chamber 2*a* through a support 101*a*, for example. The support 101*a* may be disposed in the obscuration region of the EUV light 252.

The beam splitter 102, the imaging lens 103, the image sensor 104, and the beam dump 105 may be disposed inside a detector chamber 110, which is in communication with the main chamber 2*a* through a connection hole 110*a*, for example. The pulsed laser beam 33 that has passed through the plasma generation region 25 may be reflected by the off-axis paraboloidal mirror 101. A pulsed laser beam 253, which includes the pulsed laser beam 33 reflected by the off-axis paraboloidal mirror 101, may enter the detector chamber 110 through the connection hole 110*a*. Then, the pulsed laser beam 253 may pass through the beam splitter 102, and thereafter may be imaged on the photosensitive surface of the image sensor 104 through the imaging lens 103. At this point, the image sensor 104 may be in a capture mode. For example, when the image sensor 104 is provided with a shutter or the like, the shutter may be operated such that the shutter remains open for a predetermined time in synchronization with the pulsed laser beam 253 being incident on the image sensor 104. In this way, the image sensor 104 may be arranged so as to detect an image of the pulsed laser beam 253 (that is, the pulsed laser beam 33 that has passed through the plasma generation region 25). The beam splitter 102 may transmit a part of the pulsed laser beam 253 and reflect the remaining part. The transmissivity of the beam splitter 102 may be adjusted so that the amount of light incident on the image sensor 104 is retained at or below the saturation amount of light. The pulsed laser beam reflected by the beam splitter 102 may be absorbed by the beam dump 105.

The EUV light generation controller 5 may include a reference clock generator 51*a*, an EUV light generation point controller 51, a laser beam focus control driver 52, a target controller 53, and a target supply driver 54. The EUV light generation controller 5 may integrally control the operation of the EUV light generation system 11*a*.

Specifically, the reference clock generator 51*a* may generate a reference clock that may serve as a reference for various operations. The EUV light generation point controller 51 may input various signals to the laser beam focus control driver 52, the target controller 53, and the laser apparatus 3, to thereby actuate them. The laser beam focus control driver 52 may actuate the single-axis stage 221*a* and the two-axis tilt stage 223*a* of the laser beam focusing optical system 220, based on control signals from the EUV light generation point controller 51. The target controller 53 may input a control signal to the target supply driver 54, based on the control signal inputted from the EUV light generation point controller 51 and the image data inputted from the target sensor 4. The target supply driver 54 may send an output signal to the droplet generator 26 to cause the droplet generator 26 to output the targets 27, based on the control signal inputted from the target controller 53. Further, the target supply driver 54 may actuate the two-axis stage 261, based on the control signal inputted from the target controller 53. The EUV light generation point controller 51 may send an output trigger for the pulsed laser beam 31 to the laser apparatus 3.

4.2 Operation

Subsequently, the operation of the EUV light generation system 11A shown in FIG. 2 will be described. The operation of the EUV light generation system 11A may be controlled by the EUV light generation controller 5. Accordingly, the operation of the EUV light generation controller 5 will be described below.

The EUV light generation controller 5 may receive an EUV light generation request signal and an EUV light generation position specification signal from the exposure apparatus 6. The EUV light generation request signal may be a signal for requesting the EUV light to start being generated. The EUV light generation position specification signal may include information specifying the position inside the chamber 2 at which the EUV light is to be generated. The EUV light generation controller 5, which has received these signals, may output the output signal for the target 27 to the target supply unit 260. Then, the EUV light generation controller 5 may send the output trigger of the pulsed laser beam 31 (laser output timing) to the laser apparatus so that the target 27 is irradiated by the pulsed laser beam 33 when the target 27 arrives in the plasma generation region 25.

The pulsed laser beam 31 outputted from the laser apparatus 3 may travel, as the substantially collimated pulsed laser beam 31, through the beam delivery unit 34 that includes the high-reflection mirrors 341 and 342, and may enter the chamber 2 through the window 21.

The pulsed laser beam 31 may be transformed into the pulsed laser beam 33 that is to be focused in the plasma generation region 25 by the laser beam focusing optical system 220 that includes the off-axis paraboloidal concave mirror 222 and the high-reflection mirror 223. The pulsed laser beam 33 may be focused in the plasma generation region 25 in synchronization with the timing at which the target 27 passes through the plasma generation region 25.

When the target 27 is irradiated by the pulsed laser beam 33, the target 27 may be turned into plasma, and the EUV light 251, including the EUV light 252, may be emitted from the plasma.

Of the emitted EUV light 251, the EUV light 252 may be reflected selectively by the EUV collector mirror 23 so as to be focused in the intermediate focus (IF) region 292. The EUV light 252 that has passed through the intermediate focus region 292 may then enter the exposure apparatus 6.

The pulsed laser beam 33 that has passed through the plasma generation region 25 may be reflected by the off-axis paraboloidal mirror 101. Here the off-axis paraboloidal mirror 101 may be positioned such that the pulsed laser beam 33 is incident thereon at 45 degrees. The off-axis paraboloidal mirror 101 may transform the pulsed laser beam 33 into the collimated pulsed laser beam 253. The pulsed laser beam 253 may travel through the connection hole 110*a* and be incident on the beam splitter 102 disposed inside the detector chamber 110.

The beam splitter 102 may transmit a part of the pulsed laser beam 253 incident thereon, and reflect the remaining part. The remaining pulsed laser beam 253 reflected by the beam splitter 102 may be absorbed by the beam dump 105.

The pulsed laser beam 253 that has been transmitted through the beam splitter 102 may be focused on the photosensitive surface of the image sensor 104 through the imaging lens 103. With this, the pulsed laser beam 253 (that is, the pulsed laser beam 33 that has passed through the plasma generation region 25) may be imaged on the image sensor 104. In the case where the pulsed laser beam 33 has struck the target 27, the image of the pulsed laser beam 253 may include a shadow of the target 27.

The image data captured by the image sensor 104 may be sent to the EUV light generation point controller 51 of the EUV light generation controller 5. The EUV light generation point controller 51 may send control signals to the laser beam focus control driver 52 and the target supply driver 54 based on the image data. The control signal may be inputted to the target supply driver 54 through the target controller 53. With this, the laser beam focusing optical system 220 and the target supply unit 260 may be adjusted so that the pulsed laser beam 33 and the target 27 arrive at the EUV light generation position specified in the EUV light generation position specification signal.

Specifically, the laser beam focus control driver 52 may send actuation signals to the two-axis tilt stage 223*a* for the high-reflection mirror 223 and to the single-axis stage 221*a*. With this, the laser beam focusing optical system 220 may be controlled so that the pulsed laser beam 33 passes through the EUV light generation position. Further, the target supply driver 54 may send an actuation signal to the two-axis stage 261. With this, the orientation of the target supply unit 260 may be controlled so that the target 27 passes through the EUV light generation position.

The EUV light generation point controller 51 may send the output signal to the droplet generator 26 to cause the droplet generator 26 to output the target 27, based on the image data captured by the image sensor 104. The output signal may be inputted to the droplet generator 26 through the target controller 53 and the target supply driver 54. The EUV light generation point controller 51 may send the output trigger to the laser apparatus 3 to cause the laser apparatus 3 to output the pulsed laser beam 31, based on the image data. This may make it possible for the pulsed laser beam 33 to arrive at the EUV light generation position at substantially the same timing as the timing at which the target 27 arrives at the EUV light generation position.

With the above operation being repeated, each of the targets 27 passing through the EUV light generation position may be irradiated by the pulsed laser beam 33. As a result, the EUV light generation system 11A may be controlled such that the EUV light is generated at the specified EUV light generation position. Here, the EUV light generation position may be specified by an exposure apparatus controller 61 or may be specified by another external apparatus. Alternatively, the EUV light generation position may be a fixed position determined in advance.

4.3 Effect

As has been described so far, the image of the pulsed laser beam 33 that has passed through the plasma generation region 25 may be detected, the image including the shadow of the target 27. With this, both of the positional relationship between the target 27 and the pulsed laser beam when the target 27 is irradiated by the pulsed laser beam 33 and the position at which the pulsed laser beam 33 is focused can be detected directly.

Further, based on this detection result, the position at which the pulsed laser beam 33 is focused and the position at which the target 27 passes through the plasma generation region 25 may be controlled. Accordingly, the EUV light generation position may be controlled with high precision.

4.4 Image when Target is Irradiated by Laser Beam

Figure 3:
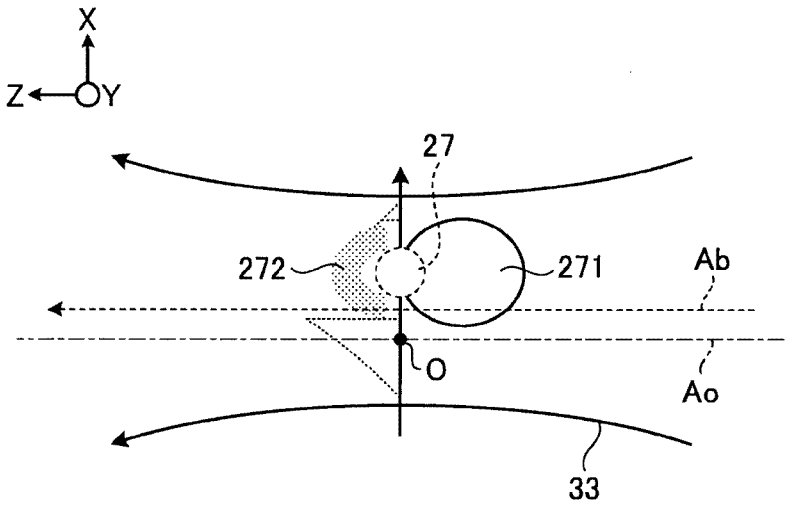
FIG. 3 illustrates a positional relationship between a target and a pulsed laser beam when the target is irradiated with the pulsed laser beam.
Figure 4:
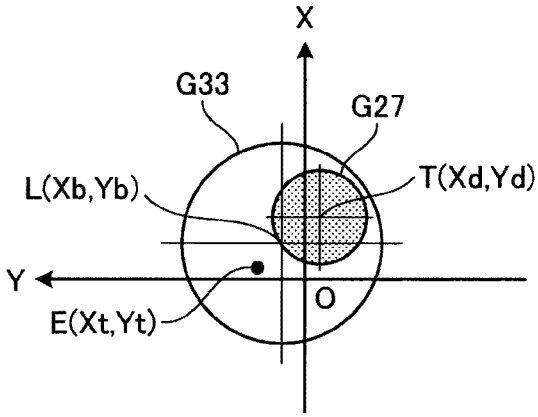
FIG. 4 illustrates an image of the pulsed laser beam detected by an image sensor of the laser beam irradiation image detector.

FIG. 3 illustrates a positional relationship between the target 27 and the pulsed laser beam 33 when the target 27 is irradiated by the pulsed laser beam 33. FIG. 4 illustrates an image of the pulsed laser beam 253 detected by the image sensor 104 of the laser beam irradiation image detector 100. In FIG. 3, an axis Ab is the beam axis of the pulsed laser beam 33, and an axis Ao is the axis passing through the reference point O. The axis Ao may extend in the Z-direction. In FIG. 4, a center E (Xt, Yt) indicates the EUV light generation position, a center L (Xb, Yb) indicates the center (corresponding to the beam axis Ab) of an image G33 of the pulsed laser beam 253, and a center T (Xd, Yd) indicates the center of an image (shadow) G27 of the target 27.

As illustrated in FIG. 3, when the target 27 is irradiated by the pulsed laser beam 33, pre-plasma 271 may be generated toward a side of the target 27 which has been irradiated by the pulsed laser beam 33, and the target material may scatter toward the opposite side, resulting in fragments 272. Further, as illustrated in FIG. 4, the image sensor 104 may capture the image G33 of the pulsed laser beam 253 and the image G27 of the target 27. The image G27 of the target 27 may include the shadow of the target 27 by the pulsed laser beam 33. Here, the posture of each of the stages for the target supply unit 260 and the laser beam focusing optical system 220 and the timing at which the target 27 is outputted may be adjusted so that the center L (Xb, Yb) of the image G33 and the center T (Xd, Yd) of the image G27 approach the EUV light generation position (the center E (Xt, Yt)), respectively.

4.5 Control Flow

Subsequently, the operation of the EUV light generation system 11A shown in FIG. 2 will be described in detail with reference to the flowcharts. The operation below may be executed based on the reference clock given by the reference clock generator 51*a* shown in FIG. 2. In the description to follow, in order to simplify the description, the frequency of the reference clock is assumed to be substantially the same as the repetition rate of the output triggers when the timing is not adjusted.

4.5.1 Main Flow

Figure 5:
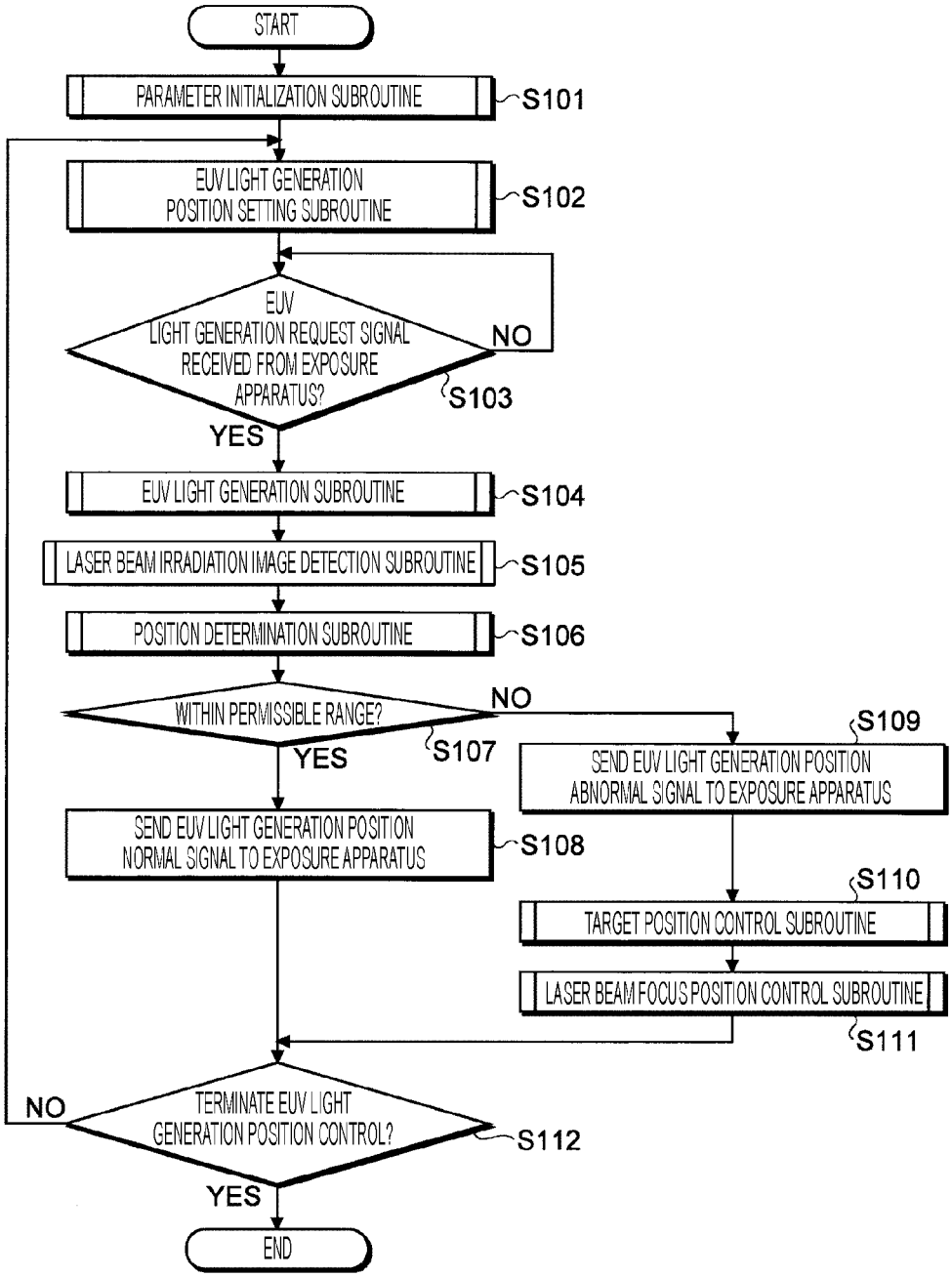
FIG. 5 shows a main flow of the operation carried out by an EUV light generation controller.

FIG. 5 shows a main flow of the operation carried out by the EUV light generation controller 5. As illustrated in FIG. 5, the EUV light generation controller 5 may first execute a parameter initialization subroutine for setting an initial value in each parameter (Step S101). Then, the EUV light generation controller 5 may execute an EUV light generation position setting subroutine for setting the EUV light generation position specified by the exposure apparatus controller 61, for example (Step S102).

Subsequently, the EUV light generation controller 5 may stand by until an EUV light generation request signal for requesting the generation of the EUV light is received from the exposure apparatus 6 (more specifically, the exposure apparatus controller 61) (Step S103; NO). Upon receiving the EUV light generation request signal (Step S103; YES), the EUV light generation controller 5 may sequentially execute an EUV light generation subroutine for generating the EUV light (Step S104), a laser beam irradiation image detection subroutine for detecting an image of the pulsed laser beam 33 passing around the target 27 (Step S105), and a position determination subroutine for determining whether or not the actual EUV light generation position falls within a permissible range (Step S106).

Thereafter, the EUV light generation controller 5 may determine, through the position determination subroutine (Step S106), whether or not the actual EUV light generation position falls within the permissible range, which may be either set in advance or inputted from an external apparatus such as the exposure apparatus 6 (Step S107). When the actual EUV light generation position falls within the permissible range (Step S107; YES), the EUV light generation controller 5 may send, to the exposure apparatus 6, an EUV light generation position normal signal indicating that the EUV light generation position falls within the permissible range (Step S108); and thereafter, the EUV light generation controller 5 may proceed to Step S112. In the mean time, when the actual EUV light generation position falls outside the permissible range (Step S107; NO), the EUV light generation controller 5 may send, to the exposure apparatus 6, an EUV light generation position abnormal signal indicating that the EUV light generation position does not fall within the permissible range (Step S109); and thereafter, the EUV light generation controller may proceed to Step S110.

In Step S110, the EUV light generation controller 5 may execute a target position control subroutine for controlling the position and the timing at which the target 27 passes through the plasma generation region 25. Subsequently, the EUV light generation controller 5 may execute a laser beam focus position control subroutine for controlling the position and the timing at which the pulsed laser beam 33 is focused (Step S111). Through these two subroutines (Steps S110 and S111), the EUV light generation system 11A may be controlled so that the target 27 is irradiated by the pulsed laser beam 33 at the specified EUV light generation position.

Thereafter, the EUV light generation controller 5 may determine whether or not this operation for controlling the EUV light generation position is to be terminated (Step S112). When the operation is to be terminated (Step S112; YES), the EUV light generation controller 5 may terminate this operation. On the other hand, when the operation is not to be terminated (Step S112; NO), the EUV light generation controller 5 may return to Step S102 and repeat the subsequent steps.

4.5.2 Parameter Initialization Subroutine

Figure 6:
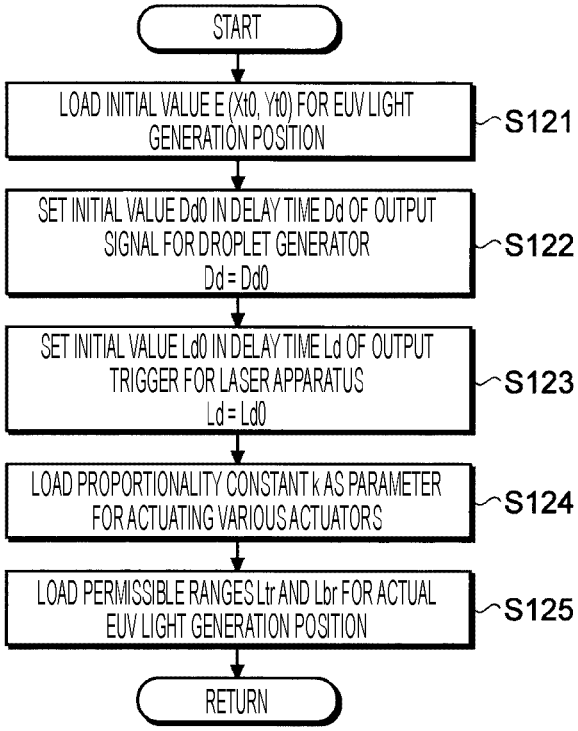
FIG. 6 shows a parameter initialization subroutine indicated in FIG. 5.

The parameter initialization subroutine shown in Step S101 of FIG. 5 will be described below with reference to FIG. 6. As shown in FIG. 6, in the parameter initialization subroutine, the EUV light generation controller 5 may load an initial value E (Xt0, Yt0) for the EUV light generation position (Step S121). The initial value E (Xt0, Yt0) may be stored in a memory (not shown) or the like, for example.

Subsequently, the EUV light generation controller 5 may set an initial value Dd0 in a delay time Dd of an output signal to be inputted to the droplet generator 26 with reference to the reference clock (Step S122). The initial value Dd0 may be stored in a memory (not shown) or the like, for example. Further, the EUV light generation controller 5 may set an initial value Ld0 in a delay time Ld for an output trigger for the pulsed laser beam 31 with respect to the timing at which the target 27 passes through a predetermined position (Step S123). The initial value Ld0 may be stored in a memory (not shown) or the like, for example. Here, the delay time Ld may be in an amount required for the target 27 to be irradiated by the pulsed laser beam 33 at the EUV light generation position, that is, a duration from an output of a passing signal of the target 27 from the target sensor 4 until the output of the output trigger, for example.

Subsequently, the EUV light generation controller 5 may load a proportionality constant k, which may serve as a parameter when actuating various actuators for the two-axis stage 261 of the target supply unit 260, the single-axis stage 221*a* of the laser beam focusing optical system 220, and so forth (Step S124). The proportionality constant k may be stored in a memory (not shown) or the like, or may be given from an external apparatus, such as the exposure apparatus 6, for example.

Thereafter, the EUV light generation controller 5 may load permissible ranges for the actual EUV light generation position (Step S125). Subsequently, the EUV light generation controller 5 may return to the operation shown in FIG. 5. Here, the permissible ranges may include a permissible range Ltr for the beam axis of the pulsed laser beam 33 and a permissible range Lbr for the passing position of the target 27.

4.5.3 EUV Light Generation Position Setting Subroutine

Figure 7:
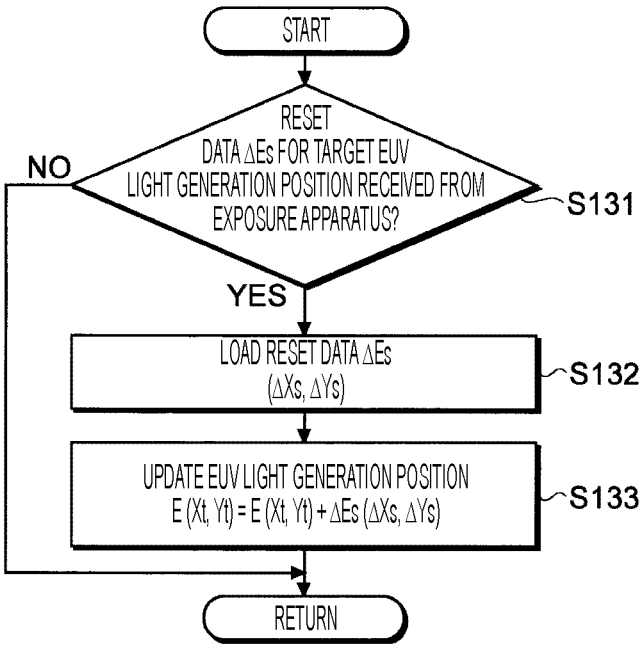
FIG. 7 shows an EUV light generation position setting subroutine indicated in FIG. 5.

The EUV light generation position setting subroutine shown in Step S102 of FIG. 5 will be described below with reference to FIG. 7. As shown in FIG. 7, in the EUV light generation position setting subroutine, the EUV light generation controller 5 may determine whether or not a resetting data ΔEs for a target EUV light generation position E has been received from the exposure apparatus 6 (Step S131). The resetting data ΔEs may be sent from the exposure apparatus controller 61 to the EUV light generation controller 5 when the EUV light generation position E requested for the EUV light generation system 11A is changed in the exposure apparatus 6, for example. Further, in this embodiment, the resetting data ΔEs is assumed to be a deviation amount (ΔXs, ΔYs) from the currently requested EUV light generation position E, but this embodiment is not limited thereto. The resetting data ΔEs may be a new EUV light generation position (coordinates).

Based on the determination result in Step S131, when the resetting data ΔEs has not been received (Step S131; NO), the EUV light generation controller 5 may return to the operation shown in FIG. 5. On the other hand, when the resetting data ΔEs has been received (Step S131; YES), the EUV light generation controller 5 may load the resetting data ΔEs (ΔXs, ΔYs) (Step S132). Subsequently, the EUV light generation controller 5 may calculate a new EUV light generation position E (Xt, Yt) by adding the resetting data ΔEs (ΔXs, ΔYs) to the current EUV light generation position E (Xt, Yt) (Step S133). With this, the target EUV light generation position E may be updated. Thereafter, the EUV light generation controller 5 may return to the operation shown in FIG. 5.

4.5.4 EUV Light Generation Subroutine

Figure 8:
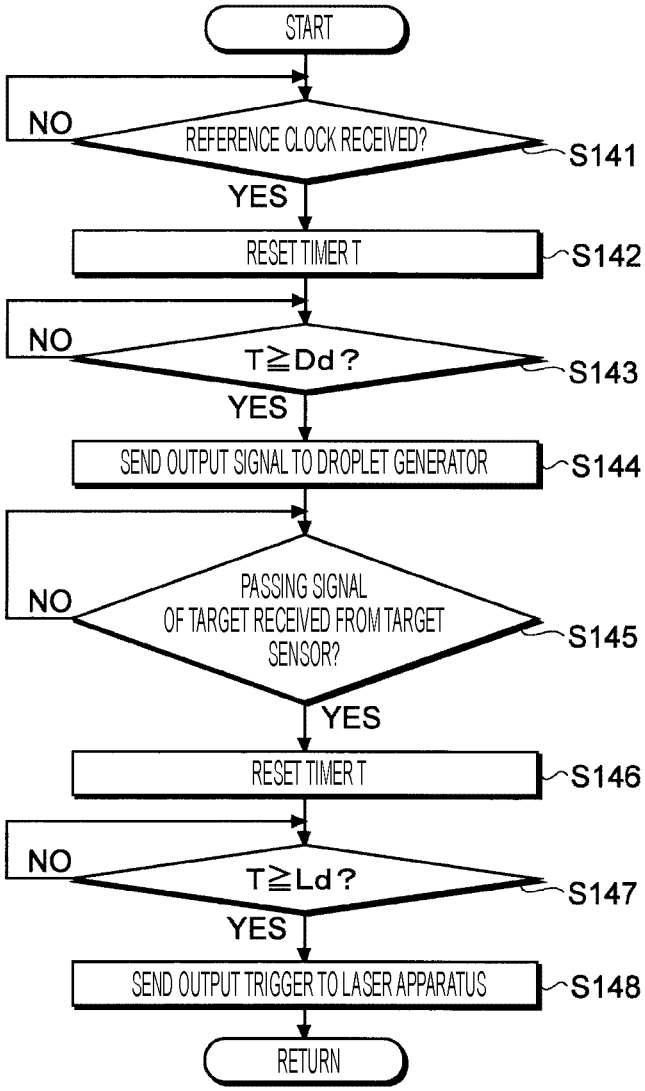
FIG. 8 shows an EUV light generation subroutine indicated in FIG. 5.

The EUV light generation subroutine shown in Step S104 of FIG. 5 will be described in detail with reference to FIG. 8 below. As shown in FIG. 8, in the EUV light generation subroutine, the EUV light generation controller 5 may stand by until it receives the reference clock (Step S141; NO). Upon receiving the reference clock (Step S141; YES), the EUV light generation controller 5 may reset a timer T (not shown) (Step S142).

Then, the EUV light generation controller 5 may stand by until a count value T in the timer T is at or exceeds the delay time Dd (Step S143; NO). When the count value T is at or exceeds the delay time Dd (Step S143; YES), the EUV light generation controller 5 may send the output signal to the target supply unit 260 to cause the target supply unit 260 to output the target 27 (Step S144).

Thereafter, the EUV light generation controller 5 may stand by until a passing signal indicating that the target 27 has passed through a predetermined position is received from the target sensor 4 (Step S145; NO). Upon receiving the passing signal (Step S145; YES), the EUV light generation controller 5 may reset the timer T (Step S146). Then, the EUV light generation controller 5 may stand by until the count value T in the timer T is at or exceeds the delay time Ld (Step S147; NO). When the count value T is at or exceeds the delay time Ld (Step S147; YES), the EUV light generation controller 5 may send an output trigger for a single pulse to the laser apparatus 3 (Step S148). Thereafter, the EUV light generation controller 5 may return to the operation shown in FIG. 5. With this, the EUV light generation system 11A may be controlled such that the pulsed laser beam 33 is focused at the EUV light generation position in synchronization with the timing at which the target 27 passes through the EUV light generation position.

4.5.5 Laser Beam Irradiation Image Detection Subroutine

Figure 9:
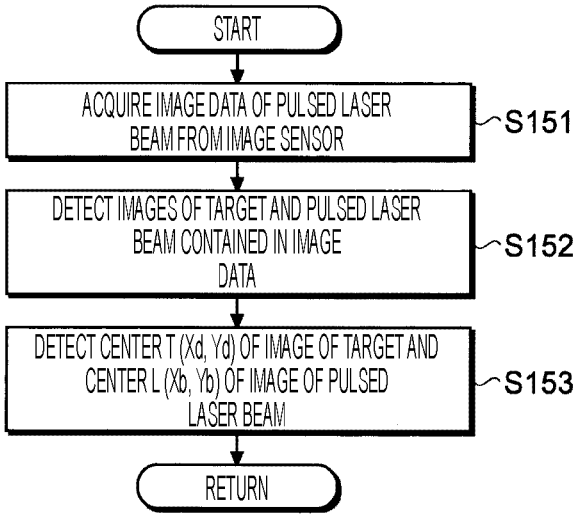
FIG. 9 shows a laser beam irradiation image detection subroutine indicated in FIG. 5.

The laser beam irradiation image detection subroutine shown in Step S105 of FIG. 5 will now be described in detail with reference to FIG. 9. As shown in FIG. 9, in the laser beam irradiation image detection subroutine, the EUV light generation controller 5 may acquire an image data of the pulsed laser beam 253 (that is, the pulsed laser beam 33 having passed through the EUV light generation position) from the image sensor 104 of the laser beam irradiation image detector 100 (Step S151). Then, the EUV light generation controller 5 may detect the image (shadow) G27 of the target 27 and the image G33 of the pulsed laser beam 253 contained in the acquired image data (Step S152). Subsequently, the EUV light generation controller 5 may detect the center T (Xd, Yd) of the detected image (shadow) G27 and the center L (Xb, Yb) of the detected image G33, respectively (Step S153). Thereafter, the EUV light generation controller 5 may return to the operation shown in FIG. 5.

4.5.6 Position Determination Subroutine

Figure 10:
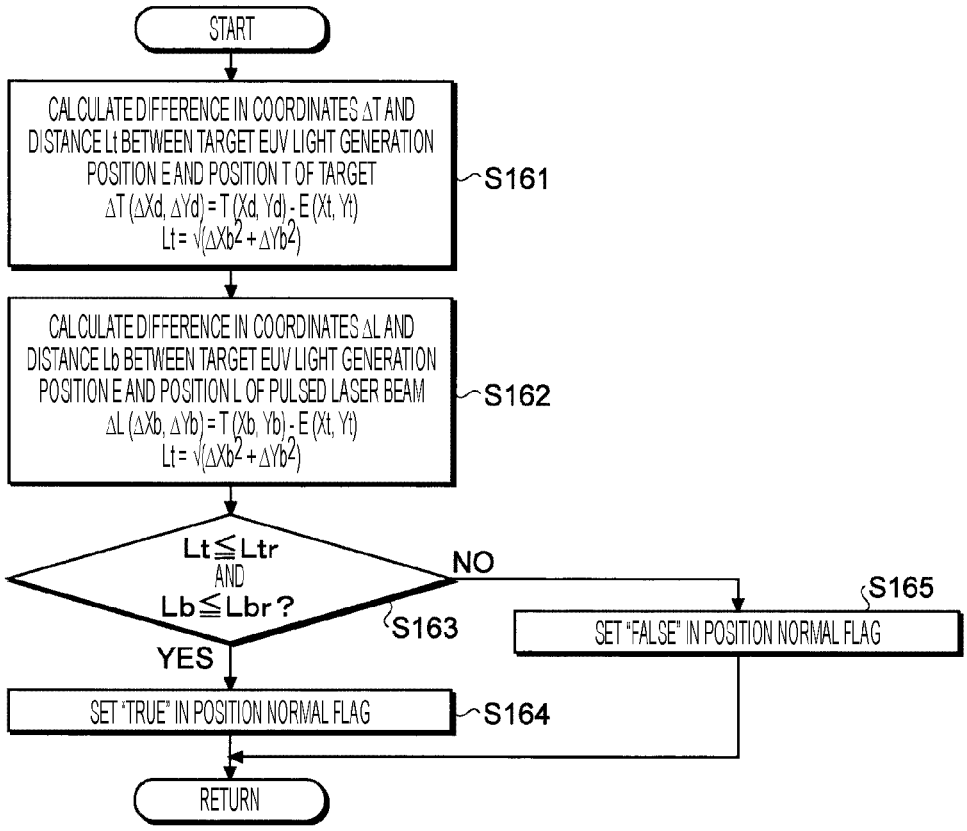
FIG. 10 shows a position determination subroutine indicated in FIG. 5.

The position determination subroutine shown in Step S106 of FIG. 5 will now be described in detail with reference to FIG. 10. As shown in FIG. 10, in the position determination subroutine, the EUV light generation controller 5 may first calculate a distance Lt between the EUV light generation position E and the position (the center T (Xd, Yd), for example) of the target 27 (Step S161). The distance Lt may be obtained by calculating a difference in coordinates ΔT (ΔXd, ΔYd) of the target 27 with respect to the EUV light generation position E. The difference in coordinates ΔT (ΔXd, ΔYd) may, for example, be obtained from the target EUV light generation position E (Xt, Yt) and the position (the center T (Xd, Yd), for example) of the target 27. The calculated difference in coordinates ΔT and the calculated distance Lt may be stored in a memory (not shown) or the like, for example. Here, the deviation in the Z-direction is not taken into consideration. However, when the deviation in the Z-direction is to be taken into consideration, the size of the image G27 of the target 27 in the image data may be used.

Further, the EUV light generation controller 5 may calculate a distance Lb between the EUV light generation position E and the position (the center L (Xb, Yb), for example) of the pulsed laser beam 33 (Step S162). The distance Lb may be obtained by calculating a difference in coordinates ΔL (ΔXb, ΔYb) of the pulsed laser beam 33 with respect to the EUV light generation position E. The difference in coordinates ΔL (ΔXb, ΔYb) may, for example, be obtained from the target EUV light generation position E (Xt, Yt) and the position (the center L (Xb, Yb), for example) of the pulsed laser beam 33. The calculated difference in coordinates ΔL and the calculated distance Lb may be stored in a memory (not shown) or the like, for example. Here, the deviation of the focus position in the Z-direction is not taken into consideration. However, when the deviation in the Z-direction is to be taken into consideration, the size of the image G33 of the pulsed laser beam 253 in the image data may be used.

Subsequently, the EUV light generation controller 5 may determine whether or not the distances Lt and Lb fall within the permissible ranges Ltr and Lbr, respectively (Step S163). When the distances Lt and Lb fall within the permissible ranges Ltr and Lbr, respectively (Step S163; YES), the EUV light generation controller 5 may set "true" in a position normal flag provided in a memory (not shown), for example (Step S164). Thereafter, the EUV light generation controller 5 may return to the operation shown in FIG. 5. On the other hand, when the distances Lt and Lb fall outside the permissible ranges Ltr and Lbr, respectively (Step S163; NO), the EUV light generation controller 5 may set "false" in the position normal flag (Step S165). Thereafter, the EUV light generation controller 5 may return to the operation shown in FIG. 5. In Step S107 of FIG. 5, the determination may be carried out by using this position normal flag.

4.5.7 Target Position Control Subroutine

Figure 11:
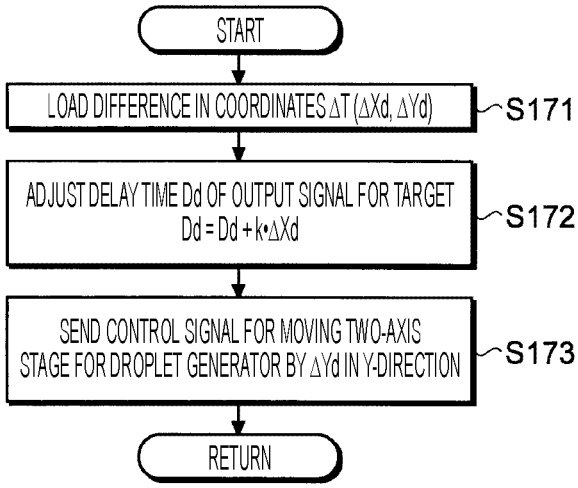
FIG. 11 shows a target position control subroutine indicated in FIG. 5.

The target position control subroutine shown in Step S110 of FIG. 5 will now be described in detail with reference to FIG. 11. As shown in FIG. 11, in the target position control subroutine, the EUV light generation controller 5 may load the difference in coordinates ΔT (ΔXd, ΔYd) obtained in Step S161 of FIG. 10 (Step S171). Subsequently, the EUV light generation controller 5 may adjust the delay time Dd for the output signal to cause the target supply unit 260 to output the target 27 by k·ΔXd (Dd=Dd+k·ΔXd), based on the difference in coordinates ΔT (Step S172). Then, the EUV light generation controller 5 may actuate the two-axis stage 261 of the target supply unit 260 so as to move the target supply unit 260 in the Y-direction by a Y adjustment amount ΔYd (Step S173). With this, the EUV light generation system 11A may be controlled such that the target 27 and the pulsed laser beam 33 reach the target EUV light generation position E at a predetermined timing. Thereafter, the EUV light generation controller 5 may return to the operation shown in FIG. 5.

4.5.7.1 Modification of Target Position Control Subroutine

Figure 12:
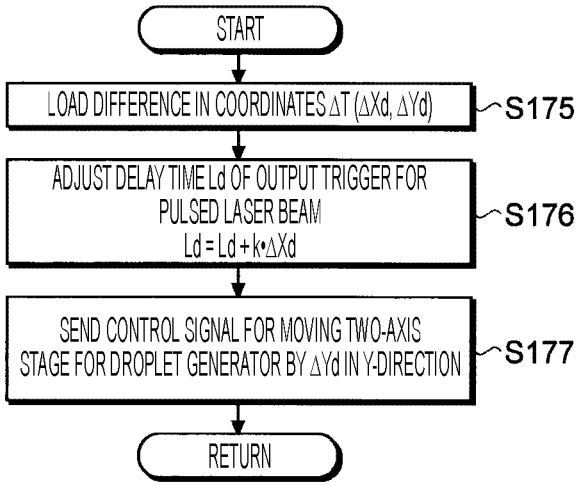
FIG. 12 shows a modification of the target position control subroutine indicated in FIG. 5.

The target position control subroutine shown in Step S110 of FIG. 5 may be modified as shown in FIG. 12 as well. As shown in FIG. 12, in the modification of the target position control subroutine, the EUV light generation controller 5 may load the difference in coordinates ΔT (ΔXd, ΔYd) obtained in Step S161 of FIG. 10 (Step S175). Subsequently, the EUV light generation controller 5 may adjust the delay time Ld for the output signal to cause the laser apparatus 3 to output the pulsed laser beam 31 by k·ΔXd (Ld=Ld+k·ΔXd), based on the difference in coordinates ΔT (Step S176). Then, the EUV light generation controller 5 may actuate the two-axis stage 261 of the target supply unit 260 so as to move the target supply unit 260 in the Y-direction by the Y adjustment amount ΔYd (Step S177). In this way, controlling the output timing of the pulsed laser beam 31 so as to shift the predetermined timing may also make it possible to control the EUV light generation system 11A such that the target 27 and the pulsed laser beam 33 reach the target EUV light generation position E at a predetermined timing. Thereafter, the EUV light generation controller 5 may return to the operation shown in FIG. 5.

4.5.8 Laser Beam Focus Position Control Subroutine

Figure 13:
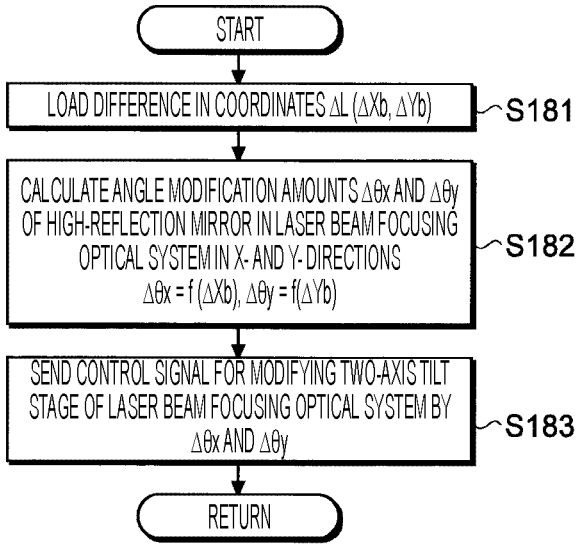
FIG. 13 shows a laser beam focus position control subroutine indicated in FIG. 5.

The laser beam focus position control subroutine shown in Step S111 of FIG. 5 will now be described in detail with reference to FIG. 13. As shown in FIG. 13, in the laser beam focus position control subroutine, the EUV light generation controller 5 may load the difference in coordinates ΔL (ΔXb, ΔYb) obtained in Step S162 of FIG. 10 (Step S181). Subsequently, the EUV light generation controller 5 may calculate angle modification amounts Δθx and Δθy of the high-reflection mirror 223 of the laser beam focusing optical system 220 in the X-direction and the Y-direction, respectively (Δθx=f(ΔXb), Δθy=f(ΔYb)), based on the difference in coordinates ΔL (Step S182). Then, the EUV light generation controller 5 may send a control signal for moving the two-axis tilt stage 223*a* holding the high-reflection mirror 223 by Δθx and Δθy (Step S183). With this, the EUV light generation system 11A may be controlled such that the pulsed laser beam 33 passes through the target EUV light generation position E at a predetermined timing. Thereafter, the EUV light generation controller 5 may return to the operation shown in FIG. 5. Here, when the focus position of the pulsed laser beam 33 is to be controlled, the single-axis stage 221*a* for the laser beam focusing optical system 220 may be moved.

As has been described so far, the EUV light generation position may be controlled with high precision by controlling the focus position of the pulsed laser beam 33 and the passing position of the target 27 based on the detection result of the image of the pulsed laser beam 253 passing though the EUV light generation position.

Figure 14:
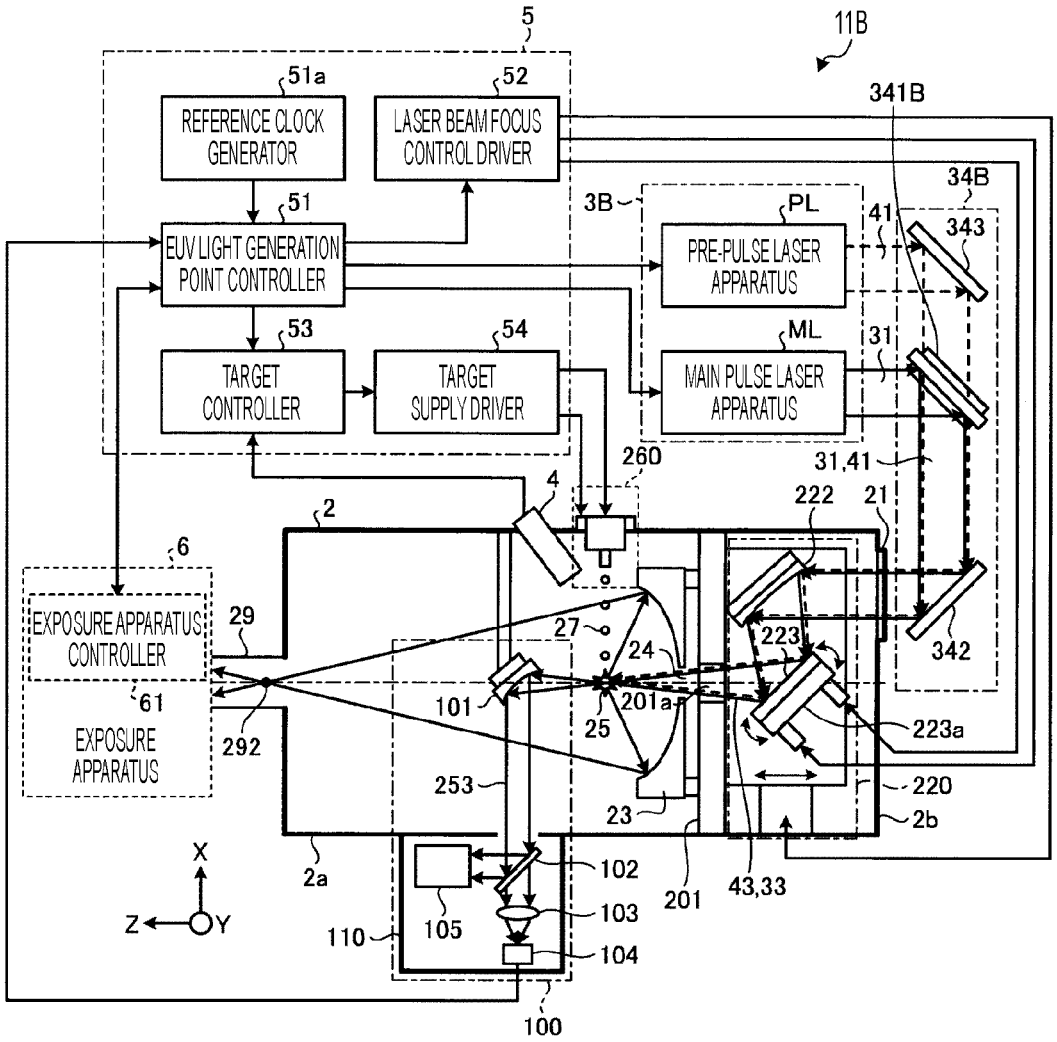
FIG. 14 schematically illustrates the configuration of an EUV light generation system according to another embodiment of this disclosure.

5. EUV Light Generation System Including Image Detector for Detecting Images when Target is Irradiated by Pre-Pulse and Main Pulse Laser Beams Subsequently, an EUV light generation system 11B configured such that a target is irradiated by laser beams in multiple stages will be described in detail with reference to the drawings. FIG. 14 schematically illustrates the configuration of the EUV light generation system 11B of a multi-stage laser irradiation type. Here, the configuration similar to that of the EUV light generation system 11A shown in FIG. 2 will be referenced by similar reference characters, and duplicate description thereof will be omitted.

5.1 Configuration

The EUV light generation system 11B shown in FIG. 14 may be similar in configuration to the EUV light generation system 11A shown in FIG. 2. However, the EUV light generation system 11B may differ from the EUV light generation system 11A in the following.

In the EUV light generation system 11B, the laser apparatus 3 may be replaced by a laser apparatus 3B, and the beam delivery unit 34 may be replaced by a beam delivery unit 34B.

The laser apparatus 3B may include a main pulse laser apparatus ML configured to output a pulsed laser beam (hereinafter, this will be referred to as a main pulse laser beam) 31 and a pre-pulse laser apparatus PL configured to output a pre-pulse laser beam 41. The beam delivery unit 34B may include a beam combiner 341B and high-reflection mirrors 342 and 343. The EUV light generation point controller 51 may be connected to each of the main pulse laser apparatus ML and the pre-pulse laser apparatus PL.

The reflective surface of the high-reflection mirror 343 may be coated with a film configured to reflect the pre-pulse laser beam 41 with high reflectivity. The beam combiner 341B may be coated with a film configured to transmit the pre-pulse laser beam 41 with high transmissivity on one surface thereof on which the main pulse laser beam 31 enters the beam combiner 341B. The beam combiner 341B may also be coated with a film configured to transmit the pre-pulse laser beam 41 with high transmissivity and reflect the main pulse laser beam 31 with high reflectivity on the other surface thereof.

The pre-pulse laser beam 41 outputted from the pre-pulse laser apparatus PL may be reflected by the high-reflection mirror 343. The reflected pre-pulse laser beam 41 may enter the beam combiner 341B. The main pulse laser beam 31 outputted from the main pulse laser apparatus ML may enter the beam combiner 341B through the surface opposite to the surface through which the pre-pulse laser beam 41 enters the beam combiner 341B. The beam combiner 341B may be embodied by a dichroic mirror, for example. The beam combiner 341B may be configured to reflect the main pulse laser beam 31 with high reflectivity and transmit the pre-pulse laser beam 41 with high transmissivity. The beam combiner 341B may be positioned such that the beam path of the reflected main pulse laser beam 31 coincides with the beam path of the transmitted pre-pulse laser beam 41. In this way, the beam combiner 341B may function as a beam path adjusting unit for making the beam path of the main pulse laser beam 31 coincides with the beam path of the pre-pulse laser beam 41. The pre-pulse laser beam 41 transmitted through the beam combiner 341B may then be reflected by the laser beam focusing optical system 220, to thereby be focused in the EUV light generation position as a pre-pulse laser beam 43.

5.2 Operation

Subsequently, the operation of the EUV light generation system 11B shown in FIG. 14 will be described. Here, the operation of the EUV light generation system 11B may be controlled by the EUV light generation controller 5. Thus, the operation of the EUV light generation controller 5 will be described below.

Upon receiving the EUV light generation request signal and the EUV light generation position specification signal from the exposure apparatus 6, the EUV light generation controller 5 may output an output signal for the target 27 to the target supply unit 260. Then, the EUV light generation controller 5 may send an output trigger for the pre-pulse laser beam 41 (laser output timing) to the pre-pulse laser apparatus PL so that the target 27 is irradiated by the pre-pulse laser beam 43 when the target 27 arrives in the plasma generation region 25.

Subsequently, the EUV light generation controller 5 may send an output trigger to the main pulse laser apparatus ML (laser output timing) such that, after the target 27 is irradiated by the pre-pulsed laser beam 43 and is diffused to a certain degree, the diffused target is irradiated by the main pulse laser beam 33. Whether the target 27 is diffused to a certain degree may be determined based on whether a predetermined delay time has elapsed since the timing at which the output trigger is sent to the pre-pulse laser apparatus PL.

The pre-pulse laser beam 41 may travel through the beam delivery unit 34B. Specifically, the pre-pulse laser beam 41 may be reflected by the high-reflection mirror 343 of the beam delivery unit 34B, be transmitted through the beam combiner 341B, and be reflected by the high-reflection mirror 342. Thereafter, the pre-pulse laser beam 41 may enter the chamber 2 through the window 21.

The pre-pulse laser beam 41 may be transformed into the pulsed laser beam 43 that may be focused in the plasma generation region 25 by the laser beam focusing optical system 220 that includes the off-axis paraboloidal concave mirror 222 and the high-reflection mirror 223. The target 27 may be supplied to the plasma generation region 25 in synchronization with the timing at which the pre-pulse laser beam 43 passes through the plasma generation region 25.

When the target 27 is irradiated by the pre-pulse laser beam 43, the target 27 may be diffused, resulting in the diffused target. The diffused target may be irradiated by the main pulse laser beam 33, whereby the target material may be turned into plasma with high efficiency. With this, an energy conversion efficiency (CE) into the EUV light may be improved.

The main pulse laser beam 33 may strike the diffused target in the same direction as the pre-pulse laser beam 43, for example. The diffused target may include fine particles or the like of the target material. Thus, apart of the main pulse laser beam 33 may pass through the diffused target without striking any of the fine particles. The part of the main pulse laser beam 33 which has passed through the diffused target may be reflected by the off-axis paraboloidal mirror 101. Here, the off-axis paraboloidal mirror 101 may be disposed such that the main pulsed laser beam 33 is incident thereon at 45 degrees. At this point, the main pulse laser beam 33 may be transformed into the collimated main pulse laser beam 253. The laser beam irradiation image detector 100 may detect the image of the main pulse laser beam 253 (that is, the main pulse laser beam 33 that has passed through the diffused target). In the case where the diffused target has been irradiated by the main pulse laser beam 33, the image of the main pulse laser beam 253 may include a shadow of the diffused target. Here, the beam path of the main pulse laser beam 33 may be set to a beam path that is offset from the beam path of the pre-pulse laser beam 43, in consideration of the position at which the diffused target is generated, the distance along which the diffused target drifts after the target 27 is irradiated by the pre-pulse laser beam 43 until the diffused target is irradiated by the main pulse laser beam 33, and so forth.

The EUV light generation point controller 51 may send control signals to the laser beam focus control driver 52 and the target supply driver 54, respectively. With this, the target supply unit 260 and the laser beam focusing optical system 220 may be controlled so that the diffused target is irradiated by the main pulse laser beam 33 in the EUV light generation position specified in the EUV light generation position specification signal received from the exposure apparatus controller 61.

Other configuration and operation may be similar to those of the EUV light generation system 11A shown in FIG. 2. Thus, detailed description thereof will be omitted here.

5.3 Effect

As has been described so far, detecting the image of the main pulse laser beam 253 (that is, the main pulse laser beam 33 that has passed through the diffused target) may make it possible to detect directly both the position at which the diffused target is irradiated by the main pulse laser beam 33 and the position at which the main pulse laser beam 33 is focused.

Further, based on this detection result, the positions at which the pre-pulse laser beam 43 and the main pulse laser beam 33 are focused and the position at which the target 27 passes through the plasma generation region 25 may be controlled. Accordingly, the EUV light generation position may be controlled with high precision.

5.4 Image when Target is Irradiated by Main Pulse Laser Beam

Figure 15:
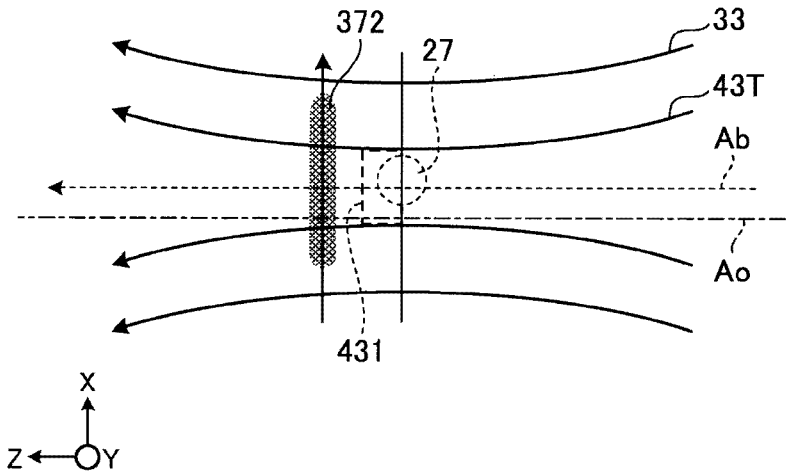
FIG. 15 illustrates a positional relationship between a main pulse laser beam and a diffused target generated as a target is irradiated by a pre-pulse laser beam.
Figure 16:
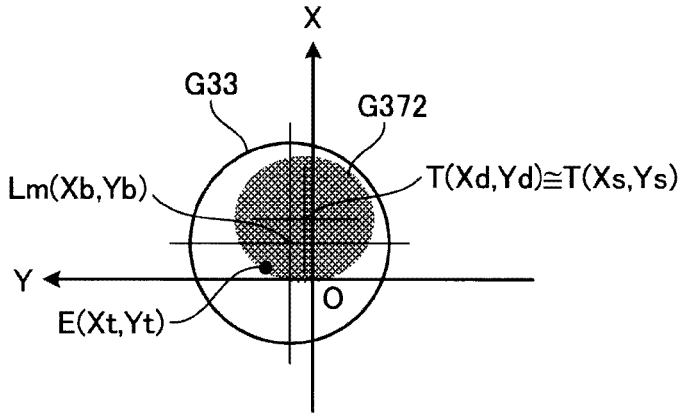
FIG. 16 illustrates an image of the main pulse laser beam detected by an image sensor of a laser beam irradiation image detector according to the embodiment.

As an example of the case where the diffused target is irradiated by the main pulse laser beam, the case where fragments are irradiated by the main pulse laser beam will be described. FIG. 15 illustrates a positional relationship between the main pulse laser beam 33 and fragments 372 resulting from the target 27 being irradiated by the pre-pulse laser beam 43. FIG. 16 illustrates the image of the main pulse laser beam 253 detected by the image sensor 104 of the laser beam irradiation image detector 100. In FIG. 15, a broken line 431 indicates a plane with substantially uniform beam intensity distribution in the beam profile of the pre-pulse laser beam 43. As can be seen from the broken line 431, the pre-pulse laser beam 43 used in this embodiment may have a so-called top-hat type beam intensity distribution. Hereinafter, the pre-pulse laser beam with such beam intensity distribution will be referred to as a top-hat pre-pulse laser beam 43T.

Figure 17:
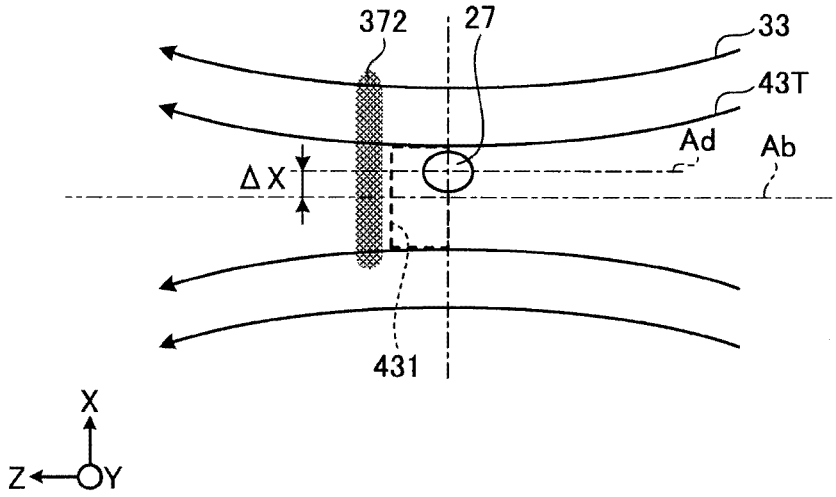
FIG. 17 illustrates a target being offset by ΔX in the +X direction with respect to the beam axis of a top-hat pre-pulse laser beam.
Figure 18:
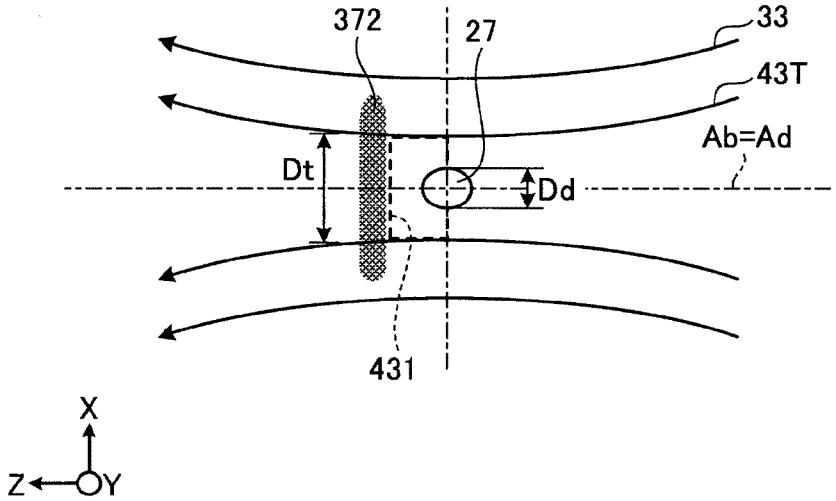
FIG. 18 illustrates the center of the target being located on the beam axis of the top-hat pre-pulse laser beam.
Figure 19:
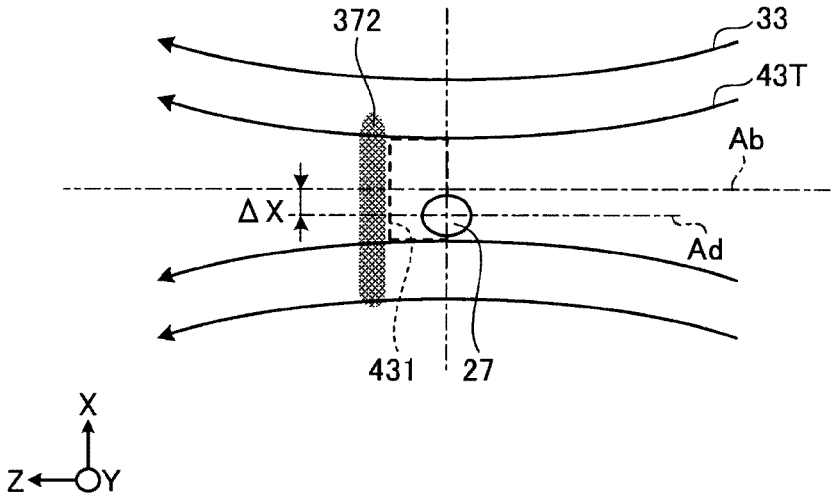
FIG. 19 illustrates the target being offset by ΔX in the −X direction with respect to the beam axis of the top-hat pre-pulse laser beam.

As illustrated in FIG. 15, when the target 27 is irradiated by the top-hat pre-pulse laser beam 43T, the target 27 may scatter. As a result, the fragments 372 may be generated toward the side of the target 27 opposite to the side irradiated with the top-hat pre-pulse laser beam 43T. As illustrated in FIG. 16, the fragments 372 may be formed generally in a disc-shape. When the beam intensity distribution along a beam profile is substantially uniform within a given region, as in the top-hat pre-pulse laser beam 43T, a center T (Xs, Ys) of the disc-shaped fragments 372 may substantially coincide with the center T (Xd, Yd) of the target 27 in the image detected by the image sensor 104. The rationale for this will be discussed with reference to FIGS. 17 through 19. In FIGS. 17 and 19, the case where the center line Ad that passes through the center of the target 27 and that is parallel to the beam axis Ab of the top-hat pre-pulse laser beam 43T is deviated from the beam axis Ab. Further, the target 27 is assumed to be contained in its entirety in the rays of the top-hat pre-pulse laser beam 43T. In this case, as long as the target 27 is contained in its entirety in the rays of the top-hat pre-pulse laser beam 43T, a heat input region on the surface of the target 27 may have substantially uniform heat input distribution. When the heat input condition on the surface of the target 27 is constant, the direction into which the fragments 372 scatter may be substantially parallel to the direction in which the top-hat pre-pulse laser beam 43T strikes the target 27. As a result, the center line that passes through the center of the fragments 372 and that is parallel to the beam axis Ab may substantially coincide with the center line Ad of the target 27. FIG. 17 illustrates a case where the target 27 is shifted by ΔX in the +X direction with respect to the beam axis Ab of the top-hat pre-pulse laser beam 43T. FIG. 18 illustrates a case where the beam axis Ab of the top-hat pre-pulse laser beam 43T passes through the center of the target 27. FIG. 19 illustrates a case where the target 27 is shifted by ΔX in the −X direction with respect to the beam axis Ab of the top-hat pre-pulse laser beam 43T. As illustrated in FIGS. 17 through 19, when observed in the direction of the beam axis Ab of the top-hat pre-pulse laser beam 43T, the center T (Xs, Ys) of the fragments 372 and the center T (Xd, Yd) of the target 27 may be detected to substantially coincide with each other.

By analyzing the image detected by the image sensor 104, the difference in coordinates ΔL between the target EUV light generation position E (Xt, Yt) and a center Lm (Xb, Yb) of the main pulse laser beam 33 may be obtained. The center of the top-hat pre-pulse laser beam 43T (and of the main pulse laser beam 33) may be controlled based on the obtained result. Alternatively, the difference in coordinates ΔT between the target EUV light generation position E (Xt, Yt) and the center T (Xs, Ys) of the fragments 372 may be obtained, and the position of the target 27 may be controlled based on the obtained result.

Figure 20:
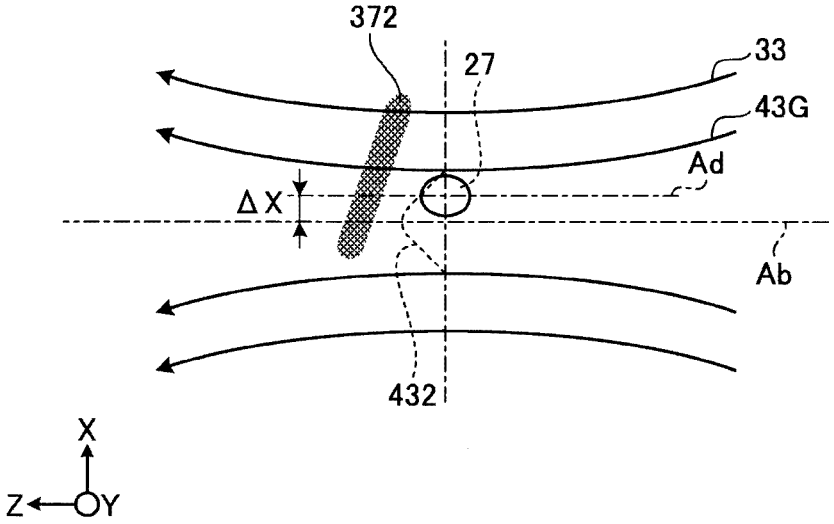
FIG. 20 illustrates a target being offset by ΔX in the +X direction with respect to the beam axis of a pre-pulse laser beam.
Figure 21:
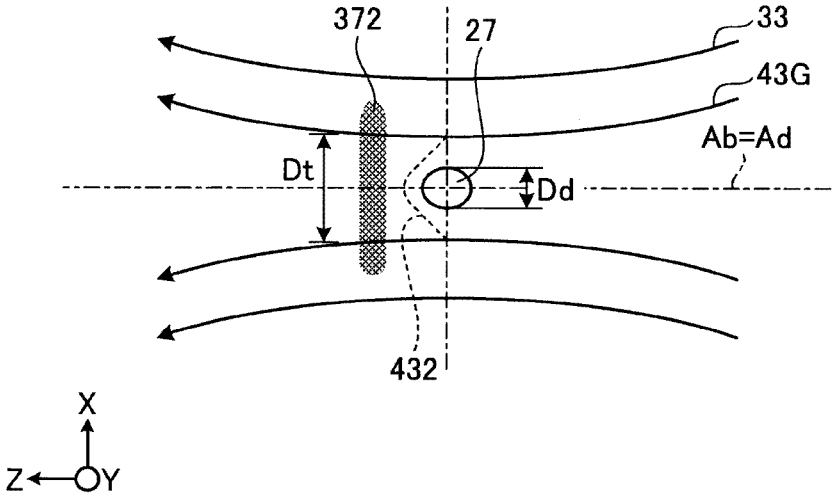
FIG. 21 illustrates the center of the target being located on the beam axis of the pre-pulse laser beam.
Figure 22:
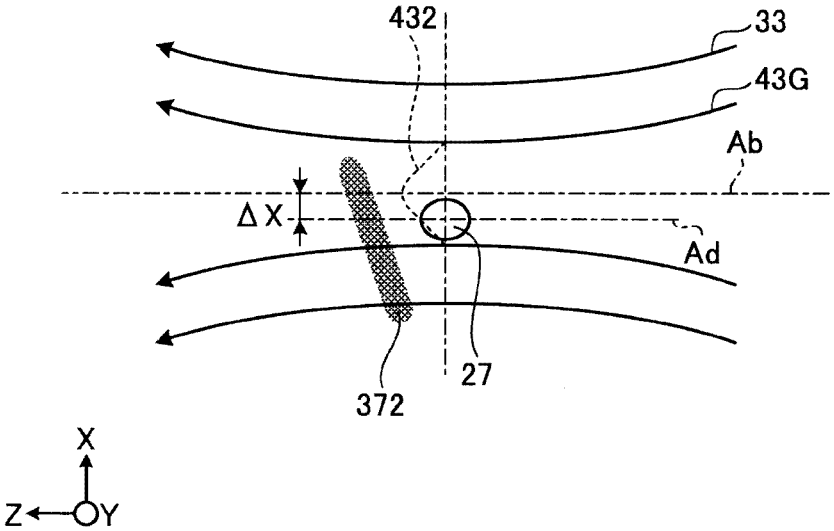
FIG. 22 illustrates the target being offset by ΔX in the −X direction with respect to the beam axis of the pre-pulse laser beam.

On the other hand, as shown by a broken line 432 in FIGS. 20 through 22, when the beam intensity distribution of a pre-pulse laser beam 43G is Gaussian, the center T (Xs, Ys) of the generated fragments 372 may change depending on the relationship between the center T (Xd, Yd) of the target 27 and a center Lp (Xb, Yb) of the pre-pulse laser beam 43G when the target 27 is irradiated by the pre-pulse laser beam 43G (the center Lp (Xb, Yb) is an intersection of the beam axis Ab and the vertical dashed line) (see FIGS. 20-22). That is, the fragments 372 may be generated in the direction into which the center T (Xd, Yd) of the target 27 is shifted with respect to the center Lp (Xb, Yb) of the pre-pulse laser beam 43G. This direction may not be parallel to the direction in which the pre-pulse laser beam 43 G strikes the target 27. FIG. 20 illustrates a case where the target 27 is shifted by ΔX in the +X direction with respect to the beam axis Ab of the pre-pulse laser beam 43G. FIG. 21 illustrates a case where the beam axis Ab of the pre-pulse laser beam 43G passes through the center of the target 27. FIG. 22 illustrates a case where the target 27 is shifted by ΔX in the −X direction with respect to the beam axis Ab of the pre-pulse laser beam 43G. When the beam intensity distribution of the pre-pulse laser beam 43G is Gaussian, the above shift amounts may preferably be considered for the difference in coordinates ΔL between the target EUV light generation position E (Xt, Yt) and the center Lm (Xb, Yb) of the main pulse laser beam 33. The position of the pre-pulse laser beam 43G (and of the main pulse laser beam 33) or the position of the target 27 may preferably be controlled based on the difference in coordinates where the shift amount is taken into consideration.

5.5 Control Flow

The operation of the EUV light generation system 11B shown in FIG. 14 will now be described in detail with reference to the drawings. The operation of the EUV light generation system 11B may be similar to the operation of the EUV light generation system 11A as shown in FIGS. 5 through 13. However, the parameter initialization subroutine shown in FIG. 6 (Step S101 of FIG. 5) may be replaced by a parameter initialization subroutine shown in FIG. 23. Further, the EUV light generation subroutine shown in FIG. 8 (Step S104 of FIG. 5) may be replaced by an EUV light generation subroutine shown in FIG. 24.

5.5.1 Parameter Initialization Subroutine

Figure 23:
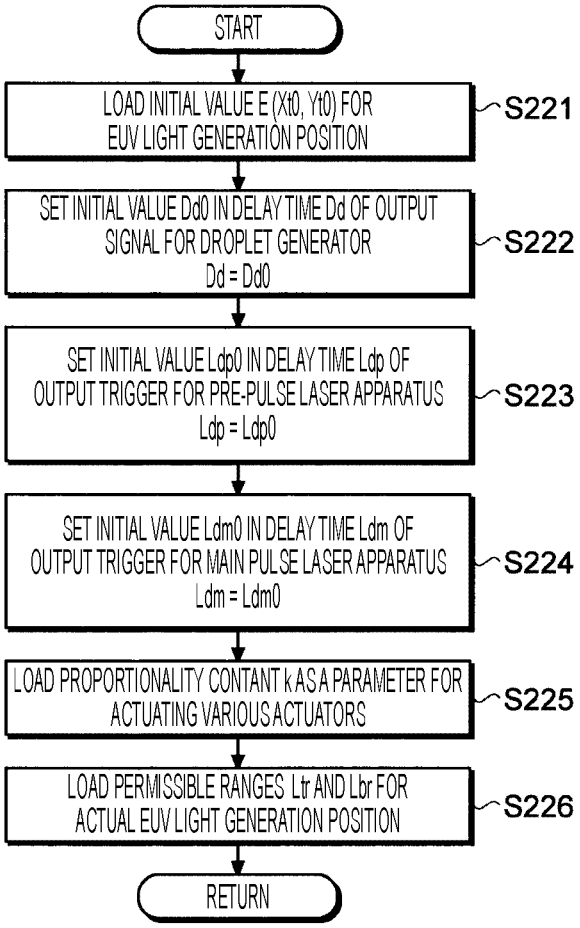
FIG. 23 shows a parameter initialization subroutine.

As shown in FIG. 23, in the parameter initialization subroutine of this embodiment, the EUV light generation controller 5 may load an initial value E (Xt0, Yt0) of the EUV light generation position (Step S221). The initial value E (Xt0, Yt0) may be stored in a memory (not shown) or the like, for example.

Then, the EUV light generation controller 5 may set an initial value Dd0 in a delay time Dd of an output signal inputted to the droplet generator 26 with respect to the reference clock (Step S222). The initial value Dd0 may be stored in a memory (not shown) or the like, for example. Further, the EUV light generation controller 5 may set an initial value Ldp0 in a delay time Ldp of an output trigger for the pre-pulse laser beam 41 with respect to the timing at which the target 27 passes through a predetermined position (Step S223). Further, the EUV light generation controller 5 may set an initial value Ldm0 in a delay time Ldm of the output trigger for the main pulse laser beam 31 with respect to the timing at which the target 27 passes through the predetermined position (Step S224). These initial values Ldp0 and Ldm0 may be stored in a memory (not shown) or the like, for example. Here, the delay time Ldp may be a delay time required for the target 27 to be irradiated by the pre-pulse laser beam 43 at the EUV light generation position, the delay time being a duration from the output of the signal for detecting that the target 27 has passed a predetermined position from the target sensor 4 until the target 27 is irradiated by the pre-pulse laser beam 43, for example. Further, the delay time Ldm may be a delay time of an irradiation timing of the main pulse laser beam 33 with respect to the pre-pulse laser beam 43.

Subsequently, the EUV light generation controller 5 may load a proportionality constant k serving as a parameter when actuating various actuators for the two-axis stage 261 of the target supply unit 260, the single-axis stage 221*a* of the laser beam focusing optical system 220, and so forth (Step S225). The proportionality constant k may be stored in a memory (not shown) or the like, or may be given from an external apparatus, such as the exposure apparatus 6, for example.

Thereafter, the EUV light generation controller 5 may load the permissible ranges for the actual EUV light generation position (Step S226). Then, the EUV light generation controller 5 may return to the operation shown in FIG. 5. Here, the permissible ranges may include the permissible range Ltr for the beam axes of the main pulse laser beam 33 and of the pre-pulse laser beam 43 and a permissible range Lbr for the passing position of the target 27.

5.5.2 EUV Light Generation Subroutine

Figure 24:
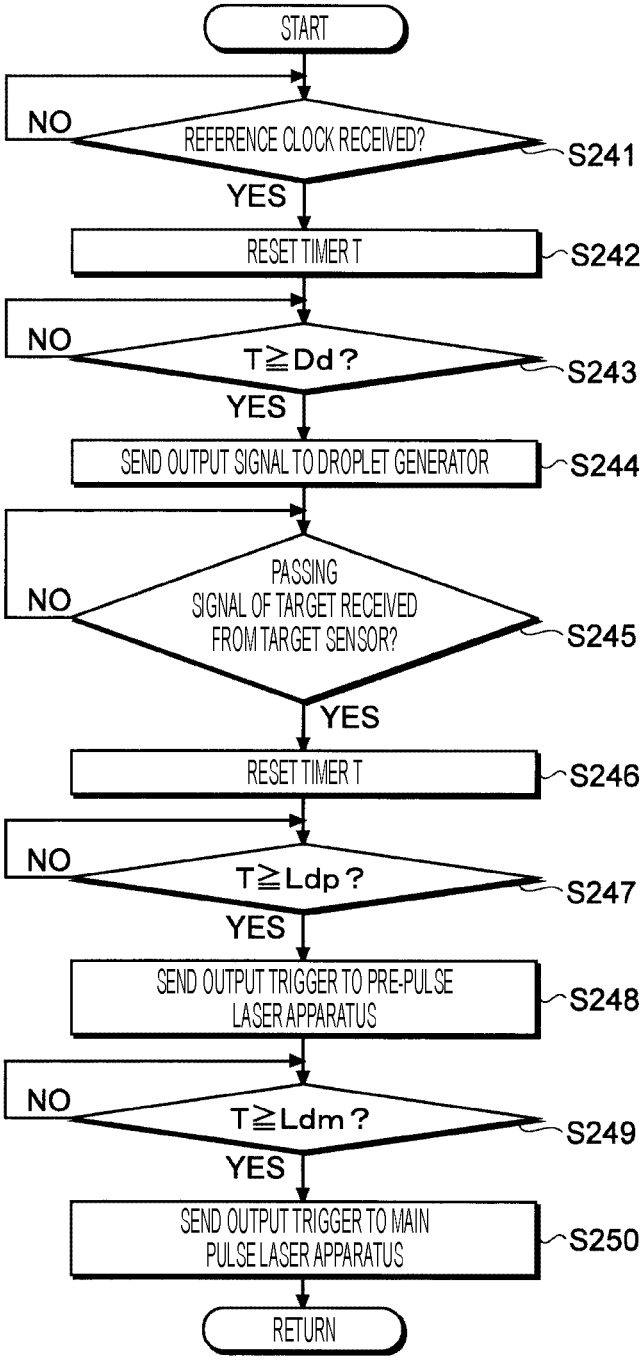
FIG. 24 shows an EUV light generation subroutine.

As shown in FIG. 24, in the EUV light generation subroutine of this embodiment, the EUV light generation controller 5 may stand by until it receives the reference clock (Step S241; NO). Upon receiving the reference clock (Step S241; YES), the EUV light generation controller 5 may reset a timer T (not shown) (Step S242).

Then, the EUV light generation controller 5 may stand by until a count value T in the timer T is at or exceeds the delay time Dd (Step S243; NO). When the count value T is at or exceeds the delay time Dd (Step S243; YES), the EUV light generation controller 5 may send the output signal to the target supply unit 260 to cause the target supply unit 260 to output the target 27 (Step S244).

Thereafter, the EUV light generation controller 5 may stand by until the passing signal indicating that the target 27 has passed through a predetermined position is received from the target sensor 4 (Step S245; NO). Upon receiving the passing signal (Step S245; YES), the EUV light generation controller 5 may reset the timer T (Step S246). Then, the EUV light generation controller 5 may stand by until the count value T in the timer T is at or exceeds the delay time Ldp of the pre-pulse laser beam 41 (Step S247; NO). When the count value T is at or exceeds the delay time Ldp (Step S247; YES), the EUV light generation controller 5 may send an output trigger for a single pulse to the pre-pulse laser apparatus PL (Step S248).

Then, the EUV light generation controller 5 may stand by until the count value T in the timer T is at or exceeds the delay time Ldm of the main pulse laser beam 31 (Step S249; NO). When the count value T is at or exceeds the delay time Ldm (Step S249; YES), the EUV light generation controller 5 may send an output trigger for a single pulse to the main pulse laser apparatus ML (Step S250). Thereafter, the EUV light generation controller 5 may return to the operation shown in FIG. 5. With this, the pre-pulse laser apparatus PL and the main laser apparatus ML may be controlled so that the pre-pulse laser beam 43 and the main pulse laser beam 33 are outputted sequentially in synchronization with timing at which the target 27 passes through the EUV light generation position.

As has been described so far, the positions at which the pre-pulse laser beam 43 and the main pulse laser beam 33 are focused and the position at which the target 27 passes through the plasma generation region 25 may be controlled, based on the detection result of the image of the main pulse laser beam 253 passing through the EUV light generation position. Accordingly, the EUV light generation position may be controlled with high precision.

Figure 25:
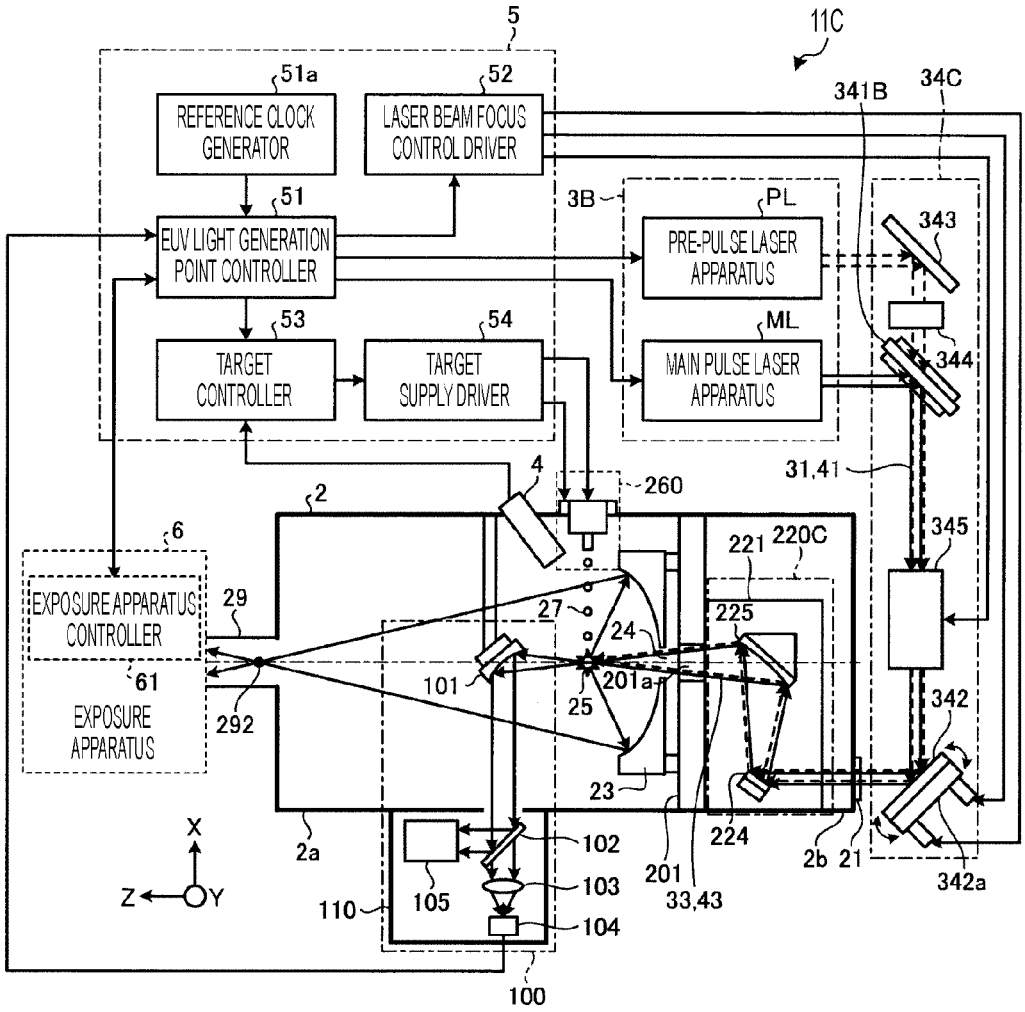
FIG. 25 schematically illustrates the configuration of an EUV light generation system according to yet another embodiment of this disclosure.

6. EUV Light Generation System in which Beam Delivery System Includes Actuator for Adjusting Focus of Laser Beam Subsequently, an EUV light generation system 11C will be described in detail with reference to the drawings. In the EUV light generation system 11C, a beam delivery unit 34C may be provided with a Z-direction laser beam focus adjusting unit 345 for controlling the focus position of the main pulse laser beam 33 and/or the pre-pulse laser beam 43. FIG. 25 schematically illustrates the configuration of the EUV light generation system 11C including the beam delivery unit 34C. In the description to follow, the configuration similar to that of the EUV light generation system 11A or 11B shown in FIG. 2 or 14 will be referenced by similar reference characters, and duplicate description thereof will be omitted.

6.1 Configuration

The EUV light generation system 11C shown in FIG. 25 may be similar in configuration to the EUV light generation system 11B shown in FIG. 14. However, the EUV light generation system 11C may differ from the EUV light generation system 11B in the following.

In the EUV light generation system 11C, the beam delivery unit 34B may be replaced by the beam delivery unit 34C, and the laser beam focusing optical system 220 may be replaced by a laser beam focusing optical system 220C.

The beam delivery unit 34C may be similar in configuration to the beam delivery unit 34B. However, in the beam delivery unit 34C, the high-reflection mirror 342 may be held by a two-axis tilt stage 342*a*. Here, the high-reflection mirror 342 and the two-axis tilt stage 342*a* may be disposed inside the chamber 2.

Further, in the beam delivery unit 34C, a top-hat mechanism 344 may be provided between the high-reflection mirror 343 and the beam combiner 341B. Alternatively, the top-hat mechanism 344 may be provided between the pre-pulse laser apparatus PL and the high-reflection mirror 343. Here, when the pre-pulse laser apparatus PL is configured to output the pre-pulse laser beam 41 having top-hat type beam intensity distribution, the top-hat mechanism 344 may be omitted. Further, in the beam delivery unit 34C, a Z-direction laser beam focus adjusting unit 345 may be provided between the beam combiner 341B and the high-reflection mirror 342.

6.2 Operation

The two-axis tilt stage 342*a* for holding the high-reflection mirror 342 may be actuated under the control of the laser beam focus control driver 52. With this, the two-axis tilt stage 342*a* may function similarly to the two-axis tilt stage 223*a* holding the high-reflection mirror 223 in the laser beam focusing optical system 220 shown in FIG. 14. In that case, in the example shown in FIG. 25, the laser beam focusing optical system 220C may be attached to the sub-chamber 2*b* or to the partition plate 201.

The top-hat mechanism 344 may be configured to transform the beam intensity distribution of the pre-pulse laser beam 41 into a top-hat type beam intensity distribution. The Z-direction laser beam focus point adjusting unit 345 may be configured to adjust the divergence of the main pulse laser beam 31 and of the pre-pulse laser beam 41, whereby the focus points of the main pulse laser beam 33 and of the pre-pulse laser beam 43 may be moved along the Z-direction.

The laser beam focusing optical system 220C may include an off-axis paraboloidal convex mirror 224 and an off-axis paraboloidal concave mirror 225. The off-axis paraboloidal convex mirror 224 may expand the pre-pulse laser beam 41 and the main pulse laser beam 31 incident thereon in diameter. The off-axis paraboloidal concave mirror 225 may focus the pre-pulse laser beam 41 and the main pulse laser beam 31, which have been expanded in diameter by the off-axis paraboloidal convex mirror 224, at the EUV light generation position as the pre-pulse laser beam 43 and the main pulse laser beam 33, respectively. The off-axis paraboloidal convex mirror 224 and the off-axis paraboloidal concave mirror 225 may be attached onto the base plate 221 such that a laser beam is incident on the respective mirrors at approximately 45 degrees. The base plate 221 may be attached to the sub-chamber 2*b* or to the partition plate 201.

6.3 Effect

In the EUV light generation system 11C shown in FIG. 25, the image of the main pulse laser beam 253 (that is, the main pulse laser beam 33 that has passed through the fragments 372) may be detected, whereby the position at which the fragments 372 are irradiated by the main pulse laser beam 33 and the position at which the main pulse laser beam 33 is focused may be detected directly.

Further, based on this detection result, the position at which the main pulse laser beam 33 is focused and the position at which the target 27 passes through the plasma generation region 25 may be controlled. Accordingly, the EUV light generation position may be controlled with high precision.

Further, the mechanisms (the two-axis tilt stage 342*a* and the Z-direction laser beam focus adjusting unit 345) for controlling the focus points of the main pulse laser beam 33 and of the pre-pulse laser beam 43 may be provided in the beam delivery unit 34C. This may allow the configuration of the laser beam focusing optical system 220C disposed inside the chamber 2 to be simplified.

7. Supplementary Descriptions 7.1 Two-Axis Tilt Stage

Figure 26:
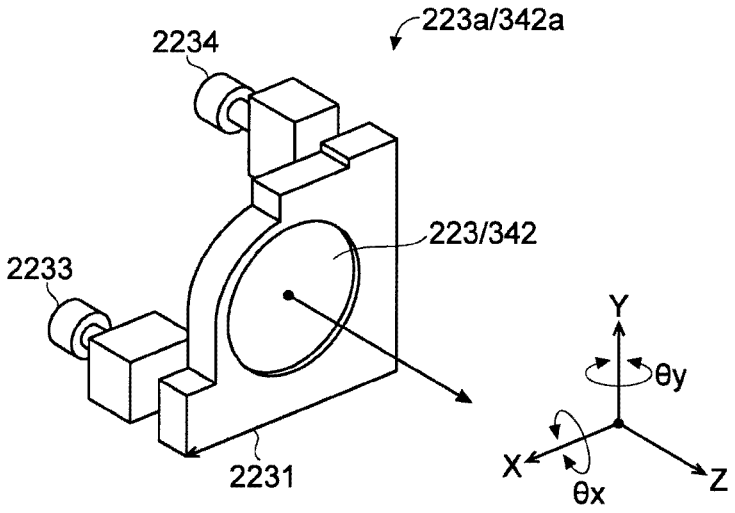
FIG. 26 is a perspective view illustrating an example of a two-axis tilt stage.

Now, an example of the aforementioned two-axis tilt stages 223*a* and 342*a* will be described with reference to the drawings. FIG. 26 is a perspective view illustrating an example of the two-axis tilt stages 223*a* and 342*a*. As illustrated in FIG. 26, the two-axis tilt stage 223*a* or 342*a* may include a holder 2231 to which the high-reflection mirror 223 or 342 is attached and two automatic micrometers 2233 and 2234, for example. Mounting the holder 2231 through the automatic micrometers 2233 and 2234 may allow the tilt angle θx in the X-direction and the tilt angle θy in the Y-direction of the high-reflection mirror 223 or 342 attached to the holder 2231 to be adjusted. Here, when the Z-direction is defined as a line normal to the reflective surface of the high-reflection mirror 223 or 342, the tilt angle θx is the pitch angle that rotates about the X-axis, and the tilt angle θy is the yaw angle that rotates about the Y-axis. A commercially available product may be used for such mirror holder 2231 provided with the two-axis tilt stage. Such commercially available products include AG-M100NV6 manufactured by Newport Corporation, for example.

7.2 Focus Position Adjusting Mechanism

Figure 27:
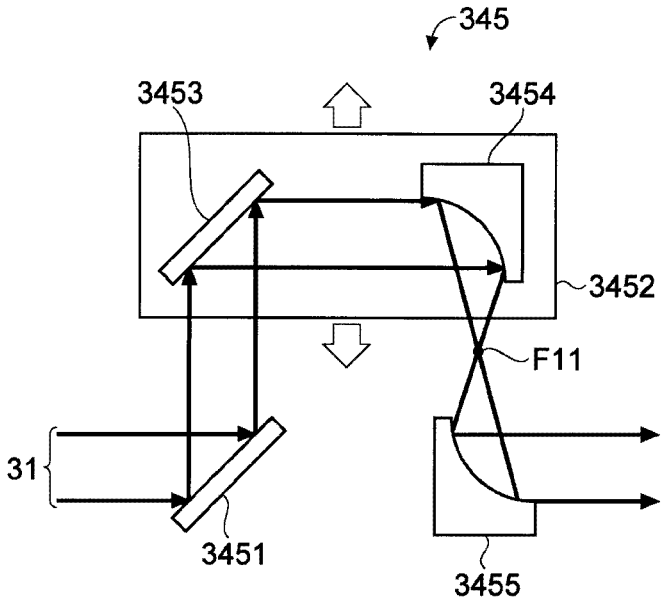
FIG. 27 illustrates an example of a Z-direction laser beam focus adjusting unit.

Subsequently, an example of the aforementioned Z-direction laser beam focus adjusting unit 345 will be described with reference to FIG. 27. As illustrated in FIG. 27, the Z-direction laser beam focus adjusting unit 345 may include high-reflection mirrors 3451 and 3453 and off-axis paraboloidal concave mirrors 3454 and 3455. The high-reflection mirror 3453 and the off-axis paraboloidal concave mirror 3454 may be attached onto a stage 3452, which is movable with respect to the high-reflection mirror 3451 and the off-axis paraboloidal concave mirror 3455. Moving the stage 3452 may allow the distance between the off-axis paraboloidal mirrors 3454 and 3455 to be adjusted. With this, the wavefront of the main pulse laser beam 31 and the pre-pulse laser beam 41 incident thereon may be adjusted to a target wavefront, respectively. As a result, the divergence of the main pulse laser beam 31 and the pre-pulse laser beam 41 may be adjusted.

7.3 Modification of Focus Position Adjusting Mechanism

Figure 28:
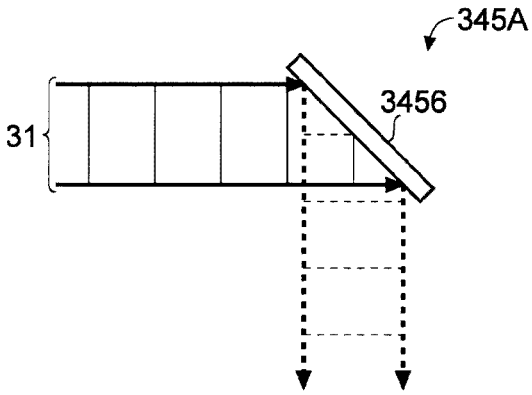
FIG. 28 illustrates a first modification of the Z-direction laser beam focus adjusting unit.
Figure 29:
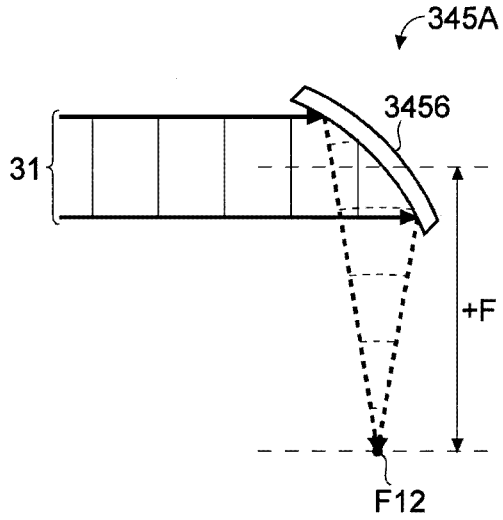
FIG. 29 illustrates a second modification of the Z-direction laser beam focus adjusting unit.
Figure 30:
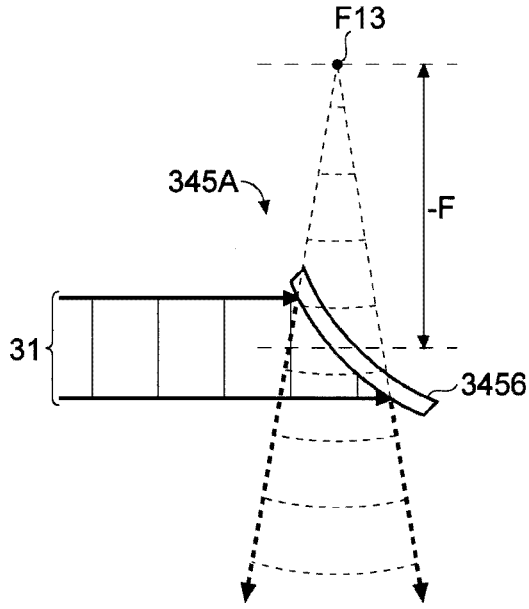
FIG. 30 illustrates a third modification of the Z-direction laser beam focus adjusting unit.

The Z-direction laser beam focus adjusting unit 345 may be modified as shown in FIGS. 28 through 30 as well. FIGS. 28 through 30 illustrate a modification of the Z-direction laser beam focus adjusting unit 345. As illustrated in FIGS. 28 through 30, a Z-direction laser beam focus adjusting unit 345A may include a deformable mirror 3456 having a reflective surface with a curvature that may be modified, for example. The deformable mirror 3456 may reflect the collimated pulsed laser beam 31 incident thereon as a collimated pulsed laser beam, when the reflective surface thereof is adjusted to be flat, as illustrated in FIG. 28. The deformable mirror 3456, when the curvature of the reflective surface thereof is adjusted to be concave, may reflect the collimated pulsed laser beam 31 incident thereon such that the pulsed laser beam 31 is focused at a predetermined focus F12 distanced therefrom by a focal distance +F, as illustrated in FIG. 29. The deformable mirror 3456, when the curvature of the reflective surface thereof is adjusted to be convex, may reflect the collimated pulsed laser beam 31 incident thereon as a convex laser beam such that the pulsed laser beam 31 is focused at a virtual focus F13 distanced therefrom by a focal distance −F, as illustrated in FIG. 30. As has been described so far, using the deformable mirror 3456 having a reflective surface with a curvature that may be modified may make it possible to adjust the wavefront of the reflected laser beam to a predetermined wavefront in accordance with the wavefront of the incident laser beam. As a result, the divergence of the main pulse laser beam 31 and the pre-pulse laser beam 41 may be adjusted.

7.4 Top-Hat Mechanism

Figure 31:
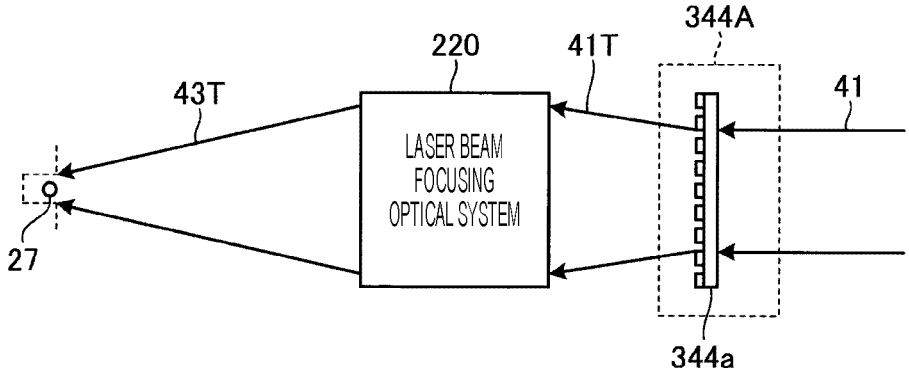
FIG. 31 schematically illustrates the configuration of a top-hat mechanism.

Subsequently, the aforementioned top-hat mechanism 344 will be described in detail with reference to the drawings. FIG. 31 schematically illustrates the configuration of a top-hat mechanism 344A serving as an example of the top-hat mechanism 344. As illustrated in FIG. 31, the top-hat mechanism 344A may include a high-precision diffractive optical element (DOE) 344*a*. The DOE 344*a* may be provided with a high-precision diffraction grating either on a surface on which the pre-pulse laser beam 41 is incident or on a surface through which the pre-pulse laser beam 41 is to be outputted. The pre-pulse laser beam 41 to be outputted from the DOE 344*a* may be diffracted three-dimensionally. As a result, diffracted rays of the pre-pulse laser beam 41 may be combined. The combined diffracted rays may be the top-hat pre-pulse laser beam 41T having the top-hat type beam intensity distribution. The outputted top-hat pre-pulse laser beam 41T may be converted into the top-hat pre-pulse laser beam 43T through the laser beam focusing optical system 220. The top-hat pre-pulse laser beam 43T may be focused at the EUV light generation position inside the chamber 2 such that the beam intensity distribution thereof is substantially uniform at the position at which the target 27 is irradiated by the top-hat pre-pulse laser beam 43T. Here, a transmissive DOE is illustrated in FIG. 31. However, this disclosure is not limited thereto, and a reflective DOE may be used as well.

7.5 First Modification of Top-Hat Mechanism

Figure 32:
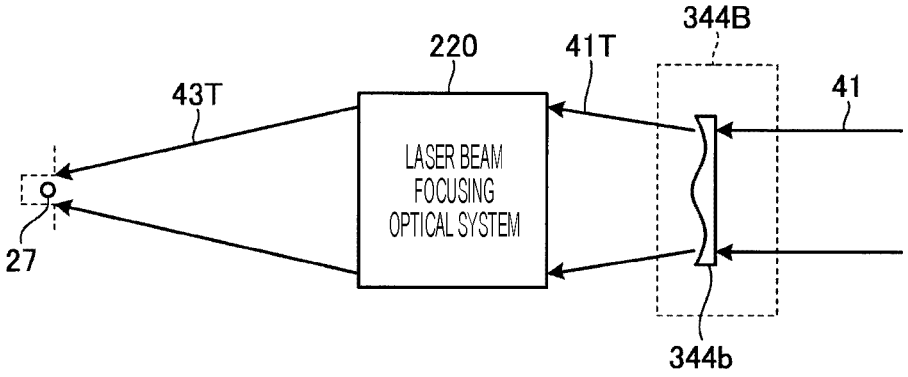
FIG. 32 schematically illustrates the configuration of a first modification of the top-hat mechanism.

FIG. 32 schematically illustrates of the configuration of a top-hat mechanism 344B according to a first modification. As illustrated in FIG. 32, the top-hat mechanism 344B may include a phase optical element 344*b*. The phase optical element 344*b* may have a wavy surface on which the pre-pulse laser beam 41 is incident or through which the pre-pulse laser beam 41 is outputted. Accordingly, the pre-pulse laser beam 41 that has passed through the phase optical element 344*b* may be subjected to a phase shift in accordance with the position at which the pre-pulse laser beam 41 passes through the phase optical element 344*b*. Rays of the pre-pulse laser beam 41 subjected to a phase shift that may differ depending on a section of the phase shift element 344*b* through which the rays have passed may be converted into the top-hat pre-pulse laser beam 41T having the top-hat type beam intensity distribution. Thereafter, the top-hat pre-pulse laser beam 41T may be converted into the top-hat pre-pulse laser beam 43T through the laser beam focusing optical system 220. Here, a transmissive phase optical element is illustrated in FIG. 32. However, this disclosure is not limited thereto, and a reflective phase optical element may be used as well.

7.6 Second Modification of Top-Hat Mechanism

Figure 33:
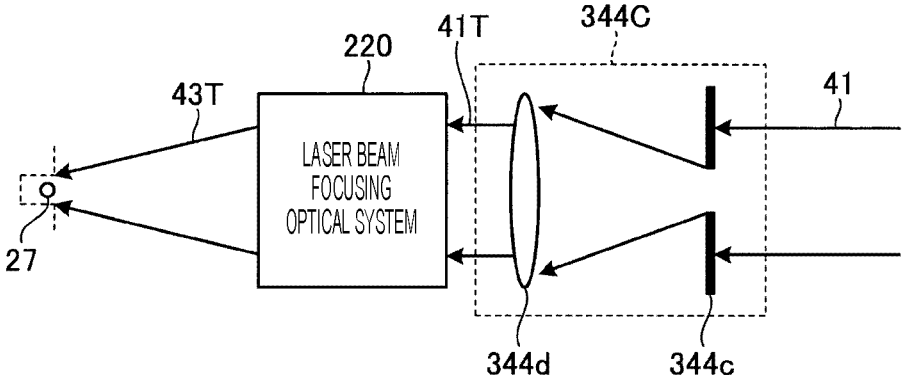
FIG. 33 schematically illustrates the configuration of a second modification of the top-hat mechanism.

FIG. 33 schematically illustrates of the configuration of a top-hat mechanism 344C according to a second modification. As illustrated in FIG. 33, the top-hat mechanism 344C may include a mask 344*c* and a collimate lens 344*d*. The mask 344*c* may be disposed such that a region of the pre-pulse laser beam 41 in which the beam intensity distribution is relatively uniform passes through the mask 344*c*. The collimate lens 344*d* may collimate the pre-pulse laser beam 41 that has been diverged after passing through the mask 344*c*. With such top-hat mechanism 344C, an image of the pre-pulse laser beam 41 at the mask 344*c* may be imaged at the EUV light generation position by the collimate lens 344*d* and the laser beam focusing optical system 220.

The above-described embodiments and the modifications thereof are merely examples for implementing this disclosure, and this disclosure is not limited thereto. Making various modifications according to the specifications or the like is within the scope of this disclosure, and other various embodiments are possible within the scope of this disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not being limited to the stated elements." The term "have" should be interpreted as "having the stated elements but not being limited to the stated elements." Further, the modifier "one (a/an)" should be interpreted as at least one or "one or more."

What is claimed is:

1. An extreme ultraviolet light generation system, comprising:

a laser apparatus configured to output a laser beam for generating extreme ultraviolet light;

a chamber provided with a window, through which the laser beam from the laser apparatus enters the chamber;

a target supply unit configured to output a target toward a predetermined position inside the chamber;

a laser beam focusing optical system positioned to reflect the laser beam toward the predetermined position inside the chamber;

a detector configured to aim at a point in a path of the laser beam downstream from the predetermined position for detecting an image of the laser beam at the predetermined position;

a target position adjusting mechanism for adjusting a direction into which the target is to be outputted;

a laser beam focus position adjusting mechanism for adjusting a focus position of the laser beam; and a controller for controlling the target position adjusting mechanism and the laser beam focus position adjusting mechanism based on the image detected by the detector.

2. The extreme ultraviolet light generation system according to claim 1, wherein the image detected by the detector includes a shadow of a target, and the controller is configured to:

calculate a difference between a target extreme ultraviolet light generation position and a position of the target based on the image detected by the detector;

control the target position adjusting mechanism based on the calculated difference;

calculate a difference between the target extreme ultraviolet light generation position and a position of the laser beam based on the image detected by the detector; and control the laser beam focus position adjusting mechanism based on the calculated difference.

3. The extreme ultraviolet light generation system according to claim 1, further comprising a laser beam focus adjusting unit for adjusting a divergence of the laser beam, wherein the controller is configured to calculate a focus position of the laser beam based on the image detected by the detector and control the laser beam focus adjusting unit based on the calculated focus position.

4. The extreme ultraviolet light generation system according to claim 1, wherein the image detected by the detector includes a shadow of a target, and the controller is configured to:

calculate a difference between a target extreme ultraviolet light generation position and a position of the target based on the image detected by the detector;

control a timing at which a subsequent target is to be outputted from the target supply unit based on the calculated difference;

calculate a difference between the target extreme ultraviolet light generation position and a position of the laser beam based on the image detected by the detector; and control a timing at which a subsequent laser beam is to be outputted from the laser apparatus based on the calculated difference.

5. An extreme ultraviolet light generation system, comprising:

a first laser apparatus configured to output a first laser beam;

a second laser apparatus configured to output a second laser beam for generating extreme ultraviolet light;

a chamber provided with a window, through which the first and second laser beams respectively from the first and second laser apparatuses enter the chamber;

a target supply unit for outputting a target toward a predetermined position inside the chamber;

a laser beam focusing optical system positioned to reflect the first and second laser beams toward the predetermined position;

a detector configured to aim at a point in a path of the second laser beam downstream from the predetermined position for detecting an image of the laser beam at the predetermined position;

a target position adjusting mechanism for adjusting a direction into which the target is to be outputted;

a laser beam focus position adjusting mechanism for adjusting a focus position of at least one of the first and second laser beams; and a controller for controlling the target position adjusting mechanism and the laser beam focus position adjusting mechanism based on the image detected by the detector.

6. A method for generating extreme ultraviolet light in a system including a laser apparatus, a chamber, a target supply unit, a laser beam focusing optical system, a detector, a target position adjusting mechanism, a laser beam focus position adjusting mechanism, and a controller, the method comprising:

detecting an image of a laser beam from the laser apparatus, the laser beam being reflected by the laser beam focusing optical system toward the predetermined position for generating the extreme ultraviolet light, the detecting step aiming at a point in a path of the laser beam downstream from the predetermined position for detecting the image of the laser beam at the predetermined position; and controlling the target position adjusting mechanism for adjusting a direction into which a target is to be outputted and the laser beam focus position adjusting mechanism based on the detected image.

7. The method according to claim 6, wherein the detected image includes a shadow of a target, and the controlling step further includes calculating a difference between a target extreme ultraviolet light generation position and a position of the target based on the detected image, and controlling the target position adjusting mechanism based on the calculated difference.

8. The method according to claim 6, wherein the controlling step further includes calculating a difference between a target extreme ultraviolet light generation position and a position of the laser beam based on the detected image, and controlling the laser beam focus position adjusting mechanism based on the calculated difference.

9. The method according to claim 6, wherein a laser beam focus adjusting unit is further provided, and the controlling step further includes calculating a focus position of the laser beam based on the detected image and controlling the laser beam focus adjusting unit based on the calculated focus position.

10. The method according to claim 6, wherein the detected image includes a shadow of a target, and the controlling step further includes:

calculating a difference between a target extreme ultraviolet light generation position and a position of the target based on the detected image;

controlling a timing at which a subsequent target is to be outputted from the target supply unit based on the calculated difference;

calcualting a difference between the target extreme ultraviolet light generation position and a position of the laser beam based on the detected image; and controlling a timing at which a subsequent laser beam is to be outputted from the laser apparatus based on the calculated difference.

11. A method for generating extreme ultraviolet light in a system including first and second laser apparatuses, a chamber, a target supply unit, a laser beam focusing optical system, a detector, a target position adjusting mechanism, a laser beam focus position adjusting mechanism, and a controller, the method comprising:

outputting first and second laser beams respectively from the first and second laser apparatuses;

detecting an image of the second laser beam from the laser apparatus, the second laser beam being reflected by the laser beam focusing optical system toward the predetermined position for generating the extreme ultraviolet light, the detecting step aiming at a point in a path of the second laser beam downstream from the predetermined position for detecting the image of the second laser beam at the predetermined position; and controlling the target position adjusting mechanism for adjusting a direction into which the target is to be outputted and the laser beam focus position adjusting mechanism based on the detected image.

* * * * *

UNITED STATES PATENT AND TRADEMARK OFFICE

CERTIFICATE OF CORRECTION

PATENT NO. : 8,847,181 B2
APPLICATION NO. : 13/402277
DATED : September 30, 2014
INVENTOR(S) : Masato Moriya et al.

It is certified that error appears in the above-identified patent and that said Letters Patent is hereby corrected as shown below:

In the claims,

COLUMN 26

Line 3, “of the laser beam” should read --of the second laser beam--.

Line 59, “calcualting” should read --calculating--.

Signed and Sealed this
Fourteenth Day of April, 2015

Michelle K. Lee

Michelle K. Lee
*Director of the United States Patent and Trademark Office*